US012344800B2

(12) United States Patent
Weiss et al.

(10) Patent No.: US 12,344,800 B2
(45) **Date of Patent: *Jul. 1, 2025**

(54) METHOD, INCLUDING A HYDROGENATION STEP, FOR TREATING PLASTIC PYROLYSIS OILS

(71) Applicants: IFP ENERGIES NOUVELLES, Rueil-Malmaison (FR); REPSOL S.A., Madrid (ES)

(72) Inventors: Wilfried Weiss, Rueil-Malmaison (FR); Dominique Decottignies, Rueil-Malmaison (FR); Jérôme Bonnardot, Rueil-Malmaison (FR); Iñigo Ribas Sangüesa, Mostoles (ES); Lidia Escudero Castejon, Mostoles (ES)

(73) Assignees: IFP ENERGIES NOUVELLES, Rueil-Malmaison (FR); REPSOL S.A., Madrid (ES)

( * ) Notice: Subject to any disclaimer, the term of this patent is extended or adjusted under 35 U.S.C. 154(b) by 0 days.

This patent is subject to a terminal disclaimer.

(21) Appl. No.: 18/270,558

(22) PCT Filed: Dec. 21, 2021

(86) PCT No.: PCT/EP2021/086988

§ 371 (c)(1),
(2) Date: Jun. 30, 2023

(87) PCT Pub. No.: WO2022/144235

PCT Pub. Date: Jul. 7, 2022

(65) Prior Publication Data

US 2024/0059977 A1 Feb. 22, 2024

(30) Foreign Application Priority Data

Jan. 4, 2021 (FR) ..... 2100026

(51) Int. Cl.
*C10G 1/10* (2006.01)
*C10G 1/00* (2006.01)
(Continued)

(52) U.S. Cl.
CPC ..... *C10G 1/002* (2013.01); *C10G 1/10* (2013.01); *C10G 65/12* (2013.01); *C10G 69/06* (2013.01);
(Continued)

(58) Field of Classification Search
None
See application file for complete search history.

(56) References Cited

U.S. PATENT DOCUMENTS 3,492,220 A * 1/1970 Lempert ..... C10G 45/36 208/210
4,498,972 A 2/1985 Toulhoat et al.
(Continued)

FOREIGN PATENT DOCUMENTS

CA 3021600 A1 11/2017
WO WO-2014001632 A1 * 1/2014 ..... C10B 53/02
(Continued)

OTHER PUBLICATIONS

International search report PCT/EP2021/086988 dated Mar. 18, 2022 (pp. 1-3).

*Primary Examiner* — In Suk C Bullock
*Assistant Examiner* — Alyssa L Cepluch
(74) *Attorney, Agent, or Firm* — Csaba Henter; MILLEN, WHITE, ZELANO & BRANIGAN

(57) ABSTRACT

The present invention relates to a process for treating a plastics pyrolysis oil, comprising:

a) hydrogenation of said feedstock in the presence of at least hydrogen and of at least one hydrogenation catalyst at an average temperature of between 140 and 340°
(Continued)

C., the outlet temperature of step a) being at least 15° C. higher than the inlet temperature of step a), to obtain a hydrogenated effluent;

b) hydrotreatment of said hydrogenated effluent in the presence of at least hydrogen and of at least one hydrotreatment catalyst, to obtain a hydrotreated effluent, the average temperature of step b) being higher than the average temperature of step a);

c) separation of the hydrotreated effluent in the presence of an aqueous stream, at a temperature of between 50 and 370° C., to obtain at least one gaseous effluent, an aqueous liquid effluent and a hydrocarbon-based liquid effluent.

15 Claims, 1 Drawing Sheet

(51) Int. Cl.
*C10G 65/12* (2006.01)
*C10G 69/06* (2006.01)

(52) U.S. Cl.
CPC ..... *C10G 2300/205* (2013.01); *C10G 2300/4006* (2013.01); *C10G 2300/4012* (2013.01); *C10G 2300/4018* (2013.01)

(56) References Cited

U.S. PATENT DOCUMENTS

| | | | | |
|---|---|---|---|---|
| 4,510,042 | A | 4/1985 | Billon et al. | |
| 4,818,743 | A | 4/1989 | Simpson et al. | |
| 4,895,995 | A * | 1/1990 | James, Jr. ..... | A62D 3/37 208/262.5 |
| 5,089,463 | A | 2/1992 | Johnson | |
| 5,221,656 | A | 6/1993 | Clark et al. | |
| 5,622,616 | A | 4/1997 | Porter et al. | |
| 5,827,421 | A | 10/1998 | Sherwood, Jr. | |
| 6,332,976 | B1 | 12/2001 | Mignard et al. | |
| 6,589,908 | B1 | 7/2003 | Ginestra et al. | |
| 7,119,045 | B2 | 10/2006 | Magna et al. | |
| 10,513,661 | B2 | 12/2019 | Narayanaswamy et al. | |
| 10,597,591 | B2 | 3/2020 | Weiss et al. | |
| 10,843,158 | B2 | 11/2020 | Plais et al. | |
| 2007/0080099 | A1 | 4/2007 | Reid et al. | |
| 2015/0001061 | A1 * | 1/2015 | Bordynuik ..... | C10L 1/06 202/112 |
| 2016/0264874 | A1 * | 9/2016 | Narayanaswamy ..... | C10G 1/10 |
| 2018/0155633 | A1 * | 6/2018 | Al-Ghamdi ..... | C10G 9/005 |
| 2019/0161683 | A1 * | 5/2019 | Narayanaswamy ... | C10G 69/14 |

FOREIGN PATENT DOCUMENTS

| | | | | |
|---|---|---|---|---|
| WO | 2018055555 | A1 | 3/2018 | |
| WO | WO-2020252228 | A1 * | 12/2020 | ..... C10B 49/22 |

* cited by examiner

METHOD, INCLUDING A HYDROGENATION STEP, FOR TREATING PLASTIC PYROLYSIS OILS

TECHNICAL FIELD

The present invention relates to a process for treating a plastics pyrolysis oil so as to obtain a hydrocarbon-based effluent which can be upgraded by being incorporated directly into a naphtha or diesel storage unit or as feedstock for a steam cracking unit. More particularly, the present invention relates to a process for treating a feedstock derived from the pyrolysis of plastic waste in order to at least partly remove impurities that said feedstock may contain in relatively high amounts.

PRIOR ART

Plastics obtained from collection and sorting channels may undergo a step of pyrolysis so as to obtain, inter alia, pyrolysis oils. These plastics pyrolysis oils are generally burnt to generate electricity and/or used as fuel in industrial boilers or urban heating.

Another route for upgrading plastics pyrolysis oils is the use of these plastics pyrolysis oils as feedstock for a steam cracking unit so as to (re)create olefins, said olefins being constituent monomers of certain polymers. However, plastic waste is generally mixtures of several polymers, for example mixtures of polyethylene, polypropylene, polyethylene terephthalate, polyvinyl chloride and polystyrene. Furthermore, depending on the applications, the plastics may contain, in addition to polymers, other compounds, such as plasticizers, pigments, dyes or polymerization catalyst residues. Plastic waste may also contain, in a minor amount, biomass originating, for example, from household waste. The treatment of waste, on the one hand, notably storage, mechanical treatments, sorting, pyrolysis, and also the storage and transport of pyrolysis oil, on the other hand, can also cause corrosion. As a result, the oils obtained from the pyrolysis of plastic waste comprise a lot of impurities, in particular diolefins, metals, notably iron, silicon, or halogenated compounds, notably chlorine-based compounds, heteroelements such as sulfur, oxygen and nitrogen, and insoluble matter, in contents that are often high and incompatible with steam cracking units or units located downstream of the steam cracking units, notably polymerization processes and selective hydrogenation processes. These impurities may give rise to operability problems and notably problems of corrosion, coking or catalytic deactivation, or alternatively incompatibility problems in the applications of the target polymers. The presence of diolefins may also lead to problems of instability of the pyrolysis oil, characterized by the formation of gums. The gums and the insoluble matter that may be present in pyrolysis oil can give rise to problems of clogging in the processes.

Furthermore, during the steam cracking step, the yields of light olefins sought for petrochemistry, notably ethylene and propylene, depend greatly on the quality of the feedstocks sent for steam cracking. The BMCI (Bureau of Mines Correlation Index) is often used to characterize hydrocarbon cuts. This index, developed for hydrocarbon-based products derived from crude oils, is calculated from the measurement of the density and the average boiling point: it is equal to 0 for a linear paraffin and to 100 for benzene. Its value is therefore all the higher if the product analysed has an aromatic condensed structure, naphthenes having an intermediate BMCI between paraffins and aromatics. Overall, the yields of light olefins increase when the paraffin content increases and therefore when the BMCI decreases. Conversely, the yields of undesired heavy compounds and/or of coke increase when the BMCI increases.

WO 2018/055555 proposes an overall process for recycling plastic waste, which is very general and relatively complex, ranging from the very step of pyrolysis of the plastic waste up to the steam cracking step. The process of patent application WO 2018/055555 comprises, inter alia, a step of hydrotreating the liquid phase obtained directly from the pyrolysis, preferably under quite stringent conditions notably in terms of temperature, for example at a temperature of between 260 and 300° C., a step of separation of the hydrotreatment effluent and then a step of hydrodealkylation of the heavy effluent separated out, preferably at a high temperature, for example between 260 and 400° C.

The unpublished patent application FR 20/01758 describes a process for treating a plastics pyrolysis oil, comprising:

a) selective hydrogenation of the olefins contained in said feedstock in the presence of hydrogen and of a selective hydrogenation catalyst, to obtain a hydrogenated effluent;

b) hydrotreatment of said hydrogenated effluent in the presence of hydrogen and of a hydrotreatment catalyst, to obtain a hydrotreatment effluent;

c) separation of the hydrotreatment effluent in the presence of an aqueous stream, at a temperature of between 50 and 370° C., to obtain a gaseous effluent, an aqueous liquid effluent and a hydrocarbon-based liquid effluent;

d) optionally, a step of fractionation of all or part of the hydrocarbon-based effluent obtained from step c), to obtain a gas stream and at least two hydrocarbon-based streams which may be a naphtha cut and a heavier cut;

e) a recycling step comprising a phase of recovering a fraction of the hydrocarbon-based effluent obtained from the separation step c) or a fraction of and/or at least one of the hydrocarbon-based streams obtained from the fractionation step d), into the selective hydrogenation step a) and/or the hydrotreatment step b).

According to application FR20/01.758, the selective hydrogenation step a) and the hydrotreatment step b) are separate steps, carried out under different conditions and in different reactors. Furthermore, according to application FR20/01.758, the selective hydrogenation step a) is carried out under mild conditions, notably at a temperature of between 100 and 250° C., which can result in premature deactivation of the catalyst. Finally, according to application FR20/01.758, the hydrotreatment step b) is generally carried out at a significantly higher temperature than the selective hydrogenation step a), notably at a temperature of between 250 and 430° C., which requires a device for heating between these two steps.

It would therefore be advantageous to carry out the diolefin hydrogenation and a part of the hydrotreatment reactions, notably a part of the olefin hydrogenation and of the hydrodemetallation reactions, notably the retention of silicon, in one and the same step and at a temperature sufficient to limit the deactivation of the catalyst.

This same step would also make it possible to benefit from the heat from hydrogenation reactions, notably hydrogenation of a part of the diolefins, so as to have an increasing temperature profile in this step and to thus be able to eliminate the need for a device for heating between the catalytic section for hydrogenation and the catalytic section for hydrotreatment.

SUMMARY OF THE INVENTION

The invention relates to a process for treating a feedstock comprising a plastics pyrolysis oil, comprising:

a) a hydrogenation step performed in a hydrogenation reaction section, using at least one fixed-bed reactor containing n catalytic beds, n being an integer greater than or equal to 1, each comprising at least one hydrogenation catalyst, said hydrogenation reaction section being fed at least with said feedstock and a gas stream comprising hydrogen, said hydrogenation reaction section being used at an average temperature of between 140 and 400° C., a partial pressure of hydrogen between 1.0 and 10.0 MPa abs. and an hourly space velocity of between 0.1 and 10.0 $h^{-1}$, the outlet temperature of the reaction section of step a) being at least 15° C. higher than the inlet temperature of the reaction section of step a), to obtain a hydrogenated effluent, b) a hydrotreatment step performed in a hydrotreatment reaction section, using at least one fixed-bed reactor containing n catalytic beds, n being an integer greater than or equal to 1, each comprising at least one hydrotreatment catalyst, said hydrotreatment reaction section being fed at least with said hydrogenated effluent obtained from step a) and a gas stream comprising hydrogen, said hydrotreatment reaction section being used at an average temperature of between 250 and 430° C., a partial pressure of hydrogen of between 1.0 and 10.0 MPa abs. and an hourly space velocity of between 0.1 and 10.0 $h^{-1}$, the average temperature of the reaction section of step b) being higher than the average temperature of the hydrogenation reaction section of step a), to obtain a hydrotreated effluent, b') optionally, a hydrocracking step performed in a hydrocracking reaction section, using at least one fixed bed containing n catalytic beds, n being an integer greater than or equal to 1, each comprising at least one hydrocracking catalyst, said hydrocracking reaction section being fed at least with said hydrotreated effluent obtained from step b) and/or with the cut comprising compounds having a boiling point greater than 175° C. obtained from step d) and a gas stream comprising hydrogen, said hydrocracking reaction section being used at an average temperature of between 250 and 450° C., a partial pressure of hydrogen of between 1.5 and 20.0 MPa abs. and an hourly space velocity of between 0.1 and 10.0 $h^{-1}$, to obtain a hydrocracked effluent which is sent to the separation step c), c) a separation step, fed with the hydrotreated effluent obtained from step b) or with the hydrocracked effluent obtained from step b') and an aqueous solution, said step being performed at a temperature of between 50 and 370° C., to obtain at least one gaseous effluent, an aqueous effluent and a hydrocarbon-based effluent, d) optionally a step of fractionating all or a portion of the hydrocarbon-based effluent obtained from step c), to obtain at least one gaseous effluent and at least one cut comprising compounds with a boiling point of less than or equal to 175° C. and one hydrocarbon-based cut comprising compounds with a boiling point of greater than 175° C.

One advantage of the process according to the invention is that of purifying an oil obtained from the pyrolysis of plastic waste of at least a part of its impurities, which makes it possible to hydrogenate it and thus to be able to upgrade it in particular by incorporating it directly into the fuel storage unit or else by making it compatible with a treatment in a steam cracking unit so as to be able in particular to obtain light olefins in increased yields, which may serve as monomers in the manufacture of polymers.

Another advantage of the invention is that of preventing risks of clogging and/or corrosion of the treatment unit in which the process of the invention is performed, the risks being exacerbated by the presence, often in large amounts, of diolefins, metals and halogenated compounds in the plastics pyrolysis oil.

The process of the invention thus makes it possible to obtain a hydrocarbon-based effluent obtained from a plastics pyrolysis oil which is at least partly freed of the impurities of the starting plastics pyrolysis oil, thus limiting the problems of operability, such as the corrosion, coking or catalytic deactivation problems, to which these impurities may give rise, in particular in steam cracking units and/or in units located downstream of the steam cracking units, notably the polymerization and hydrogenation units. The removal of at least a part of the impurities from the oils obtained from the pyrolysis of plastic waste will also make it possible to increase the range of applications of the target polymers, the application incompatibilities being reduced.

According to one variant, the process comprises step d).

According to one variant, the process comprises step b').

According to one variant, the amount of the gas stream comprising hydrogen feeding said reaction section of step a) is such that the hydrogen coverage is between 50 and 1000 $Nm^3$ of hydrogen per $m^3$ of feedstock ($Nm^3/m^3$), and preferably between 200 and 300 $Nm^3$ of hydrogen per $m^3$ of feedstock ($Nm^3/m^3$).

According to one variant, the outlet temperature of step a) is at least 30° C. higher than the inlet temperature of step a).

According to one variant, at least one fraction of the hydrocarbon-based effluent obtained from the separation step c) or at least one fraction of the naphtha cut comprising compounds with a boiling point of less than or equal to 175° C. obtained from the fractionation step d) is sent into the hydrogenation step a) and/or the hydrotreatment step b).

According to one variant, at least one fraction of the cut comprising compounds with a boiling point of greater than 175° C. obtained from the fractionation step d) is sent to the hydrogenation step a) and/or the hydrotreatment step b) and/or the hydrocracking step b').

According to one variant, the process comprises a step a0) of pretreating the feedstock comprising a plastics pyrolysis oil, said pretreatment step being carried out upstream of the hydrogenation step a) and comprises a filtration step and/or an electrostatic separation step and/or a step of washing by means of an aqueous solution and/or an adsorption step.

According to one variant, the hydrocarbon-based effluent obtained from the separation step c), or at least one of the two liquid hydrocarbon-based streams obtained from step d), is totally or partly sent to a steam cracking step e) carried out in at least one pyrolysis furnace at a temperature of between 700 and 900° C. and at a pressure of between 0.05 and 0.3 MPa relative.

According to one variant, the reaction section of step a) uses at least two reactors operating in permutable mode.

According to one variant, a stream containing an amine is injected upstream of step a).

According to one variant, said hydrogenation catalyst comprises a support chosen from alumina, silica, silica-aluminas, magnesia, clays and mixtures thereof and a hydro-dehydrogenating function comprising either at least one group VIII element and at least one group VIB element, or at least one group VIII element.

According to one variant, said hydrotreatment catalyst comprises a support chosen from the group consisting of alumina, silica, silica-aluminas, magnesia, clays and mixtures thereof and a hydro-dehydrogenating function comprising at least one group VIII element and/or at least one group VIB element.

According to one variant, the process also comprises a second hydrocracking step b") performed in a hydrocracking reaction section, using at least one fixed bed containing n catalytic beds, n being an integer greater than or equal to 1, each comprising at least one hydrocracking catalyst, said hydrocracking reaction section being fed with the cut comprising compounds having a boiling point greater than 175° C. obtained from step d) and a gas stream comprising hydrogen, said hydrocracking reaction section being used at a temperature of between 250 and 450° C., a partial pressure of hydrogen of between 1.5 and 20.0 MPa abs. and an hourly space velocity of between 0.1 and 10.0 $h^{-1}$, to obtain a hydrocracked effluent which is sent to the separation step c).

According to one variant, said hydrocracking catalyst comprises a support chosen from halogenated aluminas, combinations of boron and aluminium oxides, amorphous silica-aluminas and zeolites and a hydro-dehydrogenating function comprising at least one group VIB metal chosen from chromium, molybdenum and tungsten, alone or as a mixture, and/or at least one group VIII metal chosen from iron, cobalt, nickel, ruthenium, rhodium, palladium and platinum.

The invention also relates to the product that may be obtained, and preferably obtained via the process according to the invention.

According to this variant, the product comprises, relative to the total weight of the product:

- a total content of metallic elements of less than or equal to 5.0 ppm by weight,
- with a content of iron element of less than or equal to 100 ppb by weight,
- a content of silicon element of less than or equal to 1.0 ppm by weight,
- a sulfur content of less than or equal to 500 ppm by weight,
- a nitrogen content of less than or equal to 100 ppm by weight,
- a content of chlorine element of less than or equal to 10 ppm by weight.

According to the present invention, the pressures are absolute pressures, also written as abs., and are given in MPa absolute (or MPa abs.), unless otherwise indicated.

According to the present invention, the expressions "comprised between . . . and . . . " and "between . . . and . . . " are equivalent and mean that the limit values of the interval are included in the described range of values. If such were not the case and if the limit values were not included in the described range, such a clarification will be given by the present invention.

For the purposes of the present invention, the various ranges of parameters for a given step, such as the pressure ranges and the temperature ranges, may be used alone or in combination. For example, for the purposes of the present invention, a range of preferred pressure values can be combined with a range of more preferred temperature values.

In the text hereinbelow, particular and/or preferred embodiments of the invention may be described. They may be implemented separately or combined together without limitation of combination when this is technically feasible.

In the text hereinbelow, the groups of chemical elements are given according to the CAS classification (CRC Handbook of Chemistry and Physics, published by CRC Press, editor-in-chief D. R. Lide, 81st edition, 2000-2001). For example, group VIII according to the CAS classification corresponds to the metals of columns 8, 9 and 10 according to the new IUPAC classification.

The metal content is measured by X-ray fluorescence.

DETAILED DESCRIPTION

The Feedstock

According to the invention, a "plastics pyrolysis oil" is an oil, advantageously in liquid form at ambient temperature, obtained from the pyrolysis of plastics, preferably of plastic waste notably originating from collection and sorting channels. It can also be obtained from the pyrolysis of worn tyres.

It comprises in particular a mixture of hydrocarbon-based compounds, notably paraffins, mono- and/or diolefins, naphthenes and aromatics. At least 80% by weight of these hydrocarbon-based compounds preferably have a boiling point of less than 700° C., and preferably less than 550° C. In particular, depending on the origin of the pyrolysis oil, said oil comprises up to 70% by weight of paraffins, up to 90% by weight of olefins and up to 90% by weight of aromatics, it being understood that the sum of the paraffins, of the olefins and of the aromatics is 100% by weight of the hydrocarbon-based compounds.

The density of the pyrolysis oil, measured at 15° C. according to the ASTM D4052 method, is generally between 0.75 and 0.99 g/cm$^3$, preferably between 0.75 and 0.95 g/cm$^3$.

The plastics pyrolysis oil can additionally comprise, and usually does comprise, impurities such as metals, notably iron, silicon, or halogenated compounds, notably chlorinated compounds. These impurities may be present in the plastics pyrolysis oil in high contents, for example up to 350 ppm by weight or even 700 ppm by weight or even 1000 ppm by weight of halogen elements (notably chlorine) provided by halogenated compounds, up to 100 ppm by weight, or even 200 ppm by weight of metallic or semi-metallic elements. Alkali metals, alkaline-earth metals, transition metals, post-transition metals and metalloids may be likened to contaminants of metallic nature, referred to as metals or metallic or semi-metallic elements. In particular, the metals or metallic or semi-metallic elements that may be contained in the oils obtained from the pyrolysis of plastic waste comprise silicon, iron or both of these elements. The plastics pyrolysis oil may also comprise other impurities such as heteroelements provided notably by sulfur compounds, oxygen compounds and/or nitrogen compounds, in contents generally less than 10 000 ppm by weight of heteroelements and preferably less than 4000 ppm by weight of heteroelements.

The feedstock of the process according to the invention comprises at least one plastics pyrolysis oil. Said feedstock may consist solely of plastics pyrolysis oil(s). Preferably, said feedstock comprises at least 50% by weight, preferably between 70% and 100% by weight, of plastics pyrolysis oil, relative to the total weight of the feedstock, i.e. preferably between 50% and 100% by weight and preferably between 70% and 100% by weight of plastics pyrolysis oil.

The feedstock of the process according to the invention may comprise, in addition to the plastics pyrolysis oil(s), a conventional petroleum-based feedstock or a feedstock obtained from the conversion of biomass which is then co-treated with the plastics pyrolysis oil of the feedstock.

The conventional petroleum-based feedstock can advantageously be a cut or a mixture of cuts of the type naphtha, gas oil or gas oil under vacuum.

The feedstock obtained from the conversion of biomass can advantageously be chosen from plant oils, oils from algae or algal oils, fish oils, spent food oils, and fats of plant or animal origin, or mixtures of such feedstocks. Said plant oils may advantageously be totally or partly raw or refined, and derived from plants chosen from rapeseed, sunflower, soybean, palm, olive, coconut, coconut kernel, castor oil plant, cotton, groundnut oil, linseed oil and sea kale oil, and all oils derived, for example, from sunflower or from rapeseed by genetic modification or hybridization, this list not being limiting. Said animal fats are advantageously chosen from blubber and fats composed of residues from the food industry or derived from the catering industries. Frying oils, various animal oils, such as fish oils, tallow or lard, can also be used.

The feedstock obtained from the conversion of biomass can also be chosen from feedstocks originating from processes for thermal or catalytic conversion of biomass, such as oils which are produced from biomass, in particular from lignocellulosic biomass, with various liquefaction methods, such as hydrothermal liquefaction or pyrolysis. The term "biomass" refers to a material derived from recently living organisms, which comprises plants, animals and by-products thereof. The term "lignocellulosic biomass" denotes biomass derived from plants and from by-products thereof. The lignocellulosic biomass is composed of carbohydrate polymers (cellulose, hemicellulose) and of an aromatic polymer (lignin).

The feedstock obtained from the conversion of biomass can also advantageously be chosen from feedstocks obtained from the papermaking industry.

The plastics pyrolysis oil may be obtained from a thermal, catalytic pyrolysis treatment or else may be prepared by hydropyrolysis (pyrolysis in the presence of a catalyst and of hydrogen).

Pretreatment (Optional)

Said feedstock comprising a plastics pyrolysis oil may advantageously be pretreated in an optional pretreatment step a0), prior to the hydrogenation step a), to obtain a pretreated feedstock which feeds step a).

This optional pretreatment step a0) makes it possible to reduce the amount of contaminants, in particular the amount of iron and/or of silicon and/or of chlorine, possibly present in the feedstock comprising a plastics pyrolysis oil. Thus, an optional step a0) of pretreatment of the feedstock comprising a plastics pyrolysis oil is advantageously performed in particular when said feedstock comprises more than 10 ppm by weight, notably more than 20 ppm by weight, more particularly more than 50 ppm by weight of metallic elements, and in particular when said feedstock comprises more than 5 ppm by weight of silicon, more particularly more than 10 ppm by weight, or even more than 20 ppm by weight of silicon. Likewise, an optional step a0) of pretreatment of the feedstock comprising a plastics pyrolysis oil is advantageously carried out in particular when said feedstock comprises more than 10 ppm by weight, notably more than ppm by weight, more particularly more than 50 ppm by weight of chlorine.

Said optional pretreatment step a0) may be performed via any method known to those skilled in the art for reducing the amount of contaminants. It may notably comprise a filtration step and/or an electrostatic separation step and/or a step of washing by means of an aqueous solution and/or an adsorption step.

Said optional pre-treatment step a0) is advantageously performed at a temperature of between 0 and 150° C., preferably between 5 and 100° C., and at a pressure of between 0.15 and 10.0 MPa abs, preferably between 0.2 and 1.0 MPa abs.

According to one variant, said optional pre-treatment step a0) is performed in an adsorption section operated in the presence of at least one adsorbent, preferably of alumina type, having a specific surface area greater than or equal to 100 $m^2/g$, preferably greater than or equal to 200 $m^2/g$. The specific surface area of said at least one adsorbent is advantageously less than or equal to 600 $m^2/g$, in particular less than or equal to 400 $m^2/g$. The specific surface area of the adsorbent is a surface area measured by the BET method, i.e. the specific surface area determined by nitrogen adsorption in accordance with the standard ASTM D 3663-78 established from the Brunauer-Emmett-Teller method described in the periodical *The Journal of the American Chemical Society,* 60, 309 (1938).

Advantageously, said adsorbent comprises less than 1% by weight of metallic elements, and is preferably free of metallic elements. The term "metallic elements of the adsorbent" should be understood as referring to the elements from groups 6 to 10 of the Periodic Table of the Elements (new IUPAC classification). The residence time of the feedstock in the adsorbent section is generally between 1 and 180 minutes.

Said adsorption section of the optional step a0) comprises at least one adsorption column, preferably comprises at least two adsorption columns, preferentially between two and four adsorption columns, containing said adsorbent. When the adsorption section comprises two adsorption columns, one operating mode may be that referred to as "swing" operating according to the dedicated terminology, in which one of the columns is on-line, i.e. in service, while the other column is in reserve. When the adsorbent of the on-line column is spent, this column is isolated, while the column in reserve is placed on-line, i.e. in service. The spent adsorbent can then be regenerated in situ and/or replaced with fresh adsorbent so that the column containing it can once again be placed on-line once the other column has been isolated.

Another operating mode is to have at least two columns operating in series. When the adsorbent of the column placed at the head is spent, this first column is isolated and the spent adsorbent is either regenerated in situ or replaced with fresh adsorbent. The column is then brought back on-line in the last position, and so on. This operating mode is known as the permutable mode, or as PRS for permutable reactor system or else "lead and lag" according to the dedicated terminology. The combination of at least two adsorption columns makes it possible to overcome the possible and potentially rapid poisoning and/or clogging of the adsorbent due to the combined action of the metallic contaminants, of the diolefins, of the gums obtained from the diolefins and of the insoluble matter that may be present in the plastics pyrolysis oil to be treated. The reason for this is that the presence of at least two adsorption columns facilitates the replacement and/or regeneration of the adsorbent, advantageously without stoppage of the pretreatment unit, or even of the process, thus making it possible to reduce the risks of clogging and thus to avoid stoppage of the unit due to clogging, to control the costs and to limit the consumption of adsorbent.

According to another variant, said optional pre-treatment step a0) is performed in a section for washing with an aqueous solution, for example water, or an acidic or basic solution. This washing section can contain devices for bringing the feedstock into contact with the aqueous solution and for separating the phases so as to obtain, on the one hand, the pretreated feedstock and, on the other hand, the aqueous solution comprising impurities. Among these devices, there may for example be a stirred reactor, a decanter, a mixer-decanter and/or a cocurrent or countercurrent washing column.

Said optional pretreatment step a0) may also optionally be fed with at least a fraction of a recycle stream, advantageously obtained from step d) of the process, as a mixture with or separately from the feedstock comprising a plastics pyrolysis oil.

Said optional pretreatment step a0) thus makes it possible to obtain a pretreated feedstock which then feeds the hydrogenation step a).

Hydrogenation Step a)

According to the invention, the process comprises a hydrogenation step a) performed in a hydrogenation reaction section, using at least one fixed-bed reactor containing n catalytic beds, n being an integer greater than or equal to 1, each comprising at least one hydrogenation catalyst, said hydrogenation reaction section being fed at least with said feedstock and a gas stream comprising hydrogen, said hydrogenation reaction section being used at an average temperature of between 140 and 400° C., a partial pressure of hydrogen between 1.0 and 10.0 MPa abs. and an hourly space velocity of between 0.1 and 10.0 $h^{-1}$, the outlet temperature of the reaction section of step a) being at least 15° C. higher than the inlet temperature of the reaction section of step a), to obtain a hydrogenated effluent.

Step a) is notably carried out under hydrogen pressure and temperature conditions which make it possible to perform the hydrogenation of the diolefins and olefins at the beginning of the hydrogenation reaction section, while at the same time allowing an increasing temperature profile such that the outlet temperature of the reaction section of step a) is at least 15° C. higher than the inlet temperature of the reaction section of step a). Indeed, a required amount of hydrogen is injected so as to allow the hydrogenation of at least a part of the diolefins and olefins present in the plastics pyrolysis oil, the hydrodemetallation of at least a part of the metals, notably the retention of silicon, and also the conversion of at least a part of the chlorine (to HCl). The hydrogenation of the diolefins and olefins thus makes it possible to avoid or at least to limit the formation of "gums", i.e. polymerization of the diolefins and olefins and thus the formation of oligomers and polymers, which can clog the reaction section of the hydrotreatment step b). In parallel to the hydrogenation, the hydrodemetallation, and notably the retention of silicon during step a), makes it possible to limit the catalytic deactivation of the hydrotreatment reaction section of step b). Furthermore, the conditions of step a), notably the temperature and its increasing profile, make it possible to convert at least a part of the chlorine.

The control of the temperature is thus important in this step and must satisfy an antagonistic constraint. On the one hand, the temperature at the inlet and throughout the hydrogenation reaction section must be sufficiently low in order to allow the hydrogenation of the diolefins and olefins at the beginning of the hydrogenation reaction section. On the other hand, the inlet temperature of the hydrogenation reaction section must be sufficiently high to avoid deactivation of the catalyst. Since hydrogenation reactions, notably for hydrogenation of a part of the olefins and diolefins, are highly exothermic, an increasing temperature profile is therefore observed in the hydrogenation reaction section. This higher temperature at the end of said section makes it possible to perform the hydrodemetallation and hydrodechlorination reactions.

Thus, the outlet temperature of the reaction section of step a) is at least 15° C. higher, preferably at least 25° C. higher and particularly preferably at least 30° C. higher than the inlet temperature of the reaction section of step a).

The difference in temperature between the inlet and the outlet of the reaction section of step a) is compatible with optional injection of any gas (hydrogen) cooling stream or liquid cooling stream (for example the recycling of a stream originating from steps c) and/or d)).

The difference in temperature between the inlet and the outlet of the reaction section of step a) is exclusively due to the exothermicity of the chemical reactions performed in the reaction section and is therefore compatible without the use of a heating means (oven, heat exchanger, etc.).

The inlet temperature of the reaction section of step a) is between 135 and 385° C., preferably between 210 and 335° C.

The outlet temperature of the reaction section of step a) is between 150 and 400° C., preferably between 225 and 350° C.

According to the invention, it is advantageous to perform the hydrogenation of the diolefins and a part of the hydrotreatment reactions in one and the same step and at a temperature sufficient to limit the deactivation of the catalyst of step a) which manifests itself by a decrease in the diolefin conversion. This same step also makes it possible to benefit from the heat from hydrogenation reactions, notably hydrogenation of a part of the olefins and diolefins, so as to have an increasing temperature profile in this step and to thus be able to eliminate the need for a device for heating between the catalytic section for hydrogenation and the catalytic section for hydrotreatment.

Said reaction section performs a hydrogenation in the presence of at least one hydrogenation catalyst, advantageously at an average temperature (or WABT as defined below) of between 140 and 400° C., preferably between 220 and 350° C., particularly preferably between 260 and 330° C., a partial pressure of hydrogen of between 1.0 and 10.0 MPa abs, preferably between 1.5 and 8.0 MPa abs and at an hourly space velocity (HSV) of between 0.1 and 10.0 $h^{-1}$, preferably between 0.2 and 5.0 $h^{-1}$, and very preferably between 0.3 and 3.0 $h^{-1}$.

According to the invention, the "average temperature" of a reaction section corresponds to the weight-average bed temperature (WABT) according to the dedicated terminology, which is well known to those skilled in the art. The average temperature is advantageously determined as a function of the catalytic systems, of the devices and of the configuration thereof that are used. The average temperature (or WABT) is calculated in the following manner:

$$\mathrm{WABT}=(T_{inlet}+T_{outlet})/2$$

with $T_{inlet}$: the temperature of the effluent at the inlet of the reaction section, $T_{outlet}$: the temperature of the effluent at the outlet of the reaction section.

The hourly space velocity (HSV) is defined here as the ratio of the hourly volume flow rate of the feedstock comprising the plastics pyrolysis oil, which has optionally been pretreated, to the volume of catalyst(s).

The hydrogen coverage is defined as the ratio of the volume flow rate of hydrogen taken under standard temperature and pressure conditions relative to the volume flow rate of "fresh" feedstock, i.e. of the feedstock to be treated, which has optionally been pretreated, without taking into account any recycled fraction, at 15° C. (in normal $m^3$, written as $Nm^3$, of $H_2$ per $m^3$ of feedstock).

The amount of the gas stream comprising hydrogen ($H_2$) feeding said reaction section of step a) is advantageously such that the hydrogen coverage is between 50 and 1000 $Nm^3$ of hydrogen per $m^3$ of feedstock ($Nm^3/m^3$), preferably between 50 and 500 $Nm^3$ of hydrogen per $m^3$ of feedstock ($Nm^3/m^3$), preferably between 200 and 300 $Nm^3$ of hydrogen per $m^3$ of feedstock ($Nm^3/m^3$). Indeed, the amount of hydrogen required to allow the hydrogenation of at least a part of the diolefins and olefins and the dehydrodemetallation of at least a part of the metals, notably the retention of silicon, and also the conversion of at least a part of the chlorine (to HCl) is greater than the amount of hydrogen required to make it possible to perform only the hydrogenation of the diolefins as described in FR20/01.758.

The hydrogenation reaction section of step a) is fed at least with said feedstock comprising a plastics pyrolysis oil, or with the pretreated feedstock obtained from the optional pre-treatment step a0), and a gas stream comprising hydrogen ($H_2$). Optionally, the reaction section of said step a) may likewise also be fed with at least a fraction of a recycle stream advantageously obtained from step c) or from the optional step d).

Advantageously, the reaction section of said step a) comprises between 1 and 5 reactors, preferably between 2 and 5 reactors, and particularly preferably it comprises two reactors. The advantage of a hydrogenation reaction section comprising several reactors lies in optimized treatment of the feedstock, while at the same time making it possible to reduce the risks of clogging of the catalytic bed(s) and thus to avoid stoppage of the unit due to clogging.

According to one variant, these reactors operate in permutable mode, also known as "PRS" for Permutable Reactor System or else "lead and lag". Combination of at least two reactors in PRS mode makes it possible to isolate one reactor, to discharge the spent catalyst, to recharge the reactor with fresh catalyst and to return said reactor into service without stopping the process. The PRS technology is described in particular in patent FR2681871.

According to one particularly preferred variant, the hydrogenation reaction section of step a) comprises two reactors operating in permutable mode.

Advantageously, reactor inserts, for example of filter plate type, may be used to prevent the clogging of the reactor(s). An example of a filter plate is described in patent FR3051375.

Advantageously, said hydrogenation catalyst comprises a support, preferably a mineral support, and a hydrodehydrogenating function.

According to one variant, the hydrodehydrogenating function in particular comprises at least one group VIII element, preferably chosen from nickel and cobalt, and at least one group VIB element, preferably chosen from molybdenum and tungsten. According to this variant, the total content expressed as oxides of metallic elements from groups VIB and VIII is preferably between 1% and 40% by weight and preferentially between 5% and 30% by weight relative to the total weight of the catalyst. When the metal is cobalt or nickel, the metal content is expressed as CoO and NiO, respectively. When the metal is molybdenum or tungsten, the metal content is expressed as $MoO_3$ and $WO_3$, respectively.

The weight ratio expressed as metal oxide between the group VIB metal(s) relative to the group VIII metal(s) is preferably between 1 and 20 and preferably between 2 and 10.

According to this variant, the reaction section of said step a) comprises, for example, a hydrogenation catalyst comprising between 0.5% and 12% by weight of nickel, preferably between 1% and 10% by weight of nickel (expressed as nickel oxide NiO relative to the weight of said catalyst), and between 1% and 30% by weight of molybdenum, preferably between 3% and 20% by weight of molybdenum (expressed as molybdenum oxide $MoO_3$ relative to the weight of said catalyst) on a support, preferably a mineral support, preferably on an alumina support.

According to another variant, the hydrodehydrogenating function comprises, and preferably consists of, at least one group VIII element, preferably nickel. According to this variant, the content of nickel oxides is preferably between 1% and 50% by weight and preferably between 10% and 30% by weight relative to the weight of said catalyst. This type of catalyst is preferably used in its reduced form, on a support which is preferably mineral, preferably on an alumina support.

The support for said hydrogenation catalyst is preferably chosen from alumina, silica, silica-aluminas, magnesia, clays and mixtures thereof. Said support may contain dopant compounds, notably oxides chosen from boron oxide, in particular boron trioxide, zirconia, ceria, titanium oxide, phosphorus pentoxide and a mixture of these oxides. Preferably, said hydrogenation catalyst comprises an alumina support, optionally doped with phosphorus and optionally boron. When phosphorus pentoxide $P_2O_5$ is present, its concentration is less than 10% by weight relative to the weight of the alumina and advantageously at least 0.001% by weight relative to the total weight of the alumina. When boron trioxide $B_2O_3$ is present, its concentration is less than 10% by weight relative to the weight of the alumina and advantageously at least 0.001% relative to the total weight of the alumina. The alumina used may be, for example, a $\gamma$ (gamma) or $\eta$ (eta) alumina.

Said hydrogenation catalyst is, for example, in the form of extrudates.

Very preferably, step a) may also use, in addition to the hydrogenation catalyst(s) described above, at least one hydrogenation catalyst used in step a) comprising less than 1% by weight of nickel and at least 0.1% by weight of nickel, preferably 0.5% by weight of nickel, expressed as nickel oxide NiO relative to the weight of said catalyst, and less than 5% by weight of molybdenum and at least 0.1% by weight of molybdenum, preferably 0.5% by weight of molybdenum, expressed as molybdenum oxide $MoO_3$ relative to the weight of said catalyst, on an alumina support. This catalyst, not highly loaded with metals, can be preferably placed upstream or downstream of the hydrogenation catalyst(s) described above.

Said hydrogenation step a) makes it possible to obtain a hydrogenated effluent, i.e. an effluent with a reduced content of olefins, in particular of diolefins, and of metals, in particular of silicon. The content of impurities, in particular of diolefins, of the hydrogenated effluent obtained on conclusion of step a) is reduced relative to that of the same impurities, in particular of diolefins, included in the feedstock for the process. The hydrogenation step a) generally makes it possible to convert at least 40%, and preferably at least 60% of the diolefins and also at least 40%, preferably at least 60% of the olefins, contained in the initial feedstock. Step a) also makes it possible to remove, at least partly, other contaminants, for instance silicon and chlorine. Preferably, at least 50%, and more preferentially at least 75%, of the chlorine and of the silicon of the initial feedstock are removed during step a). The hydrogenated effluent obtained on conclusion of the hydrogenation step a), is sent, preferably directly, to the hydrotreatment step b).

Hydrotreatment Step b)

According to the invention, the treatment process comprises a hydrotreatment step b) performed in a hydrotreatment reaction section, using at least one fixed-bed reactor containing n catalytic beds, n being an integer greater than or equal to 1, each comprising at least one hydrotreatment catalyst, said hydrotreatment reaction section being fed at least with said hydrogenated effluent obtained from step a) and a gas stream comprising hydrogen, said hydrotreatment reaction section being used at an average temperature of between 250 and 430° C., a partial pressure of hydrogen of between 1.0 and 10.0 MPa abs. and an hourly space velocity of between 0.1 and 10.0 $h^{-1}$, the average temperature of the reaction section of step b) being higher than the average temperature of the hydrogenation reaction section of step a), to obtain a hydrotreated effluent.

Advantageously, step b) implements hydrotreatment reactions that are well known to those skilled in the art, and more particularly hydrotreatment reactions, such as the hydrogenation of aromatics, hydrodesulfurization and hydrodeazotization. Furthermore, the hydrogenation of the olefins and of the remaining halogenated compounds and also the hydrodemetallation are continued.

Said hydrotreatment reaction section is advantageously implemented at a pressure equivalent to that used in the reaction section of the hydrogenation step a), but at a higher average temperature than that of the reaction section of the hydrogenation step a). Thus, said hydrotreatment reaction section is advantageously implemented at an average hydrotreatment temperature of between 250 and 430° C., preferably between 280 and 380° C., at a partial pressure of hydrogen of between 1.0 and 10.0 MPa abs., and at an hourly space velocity (HSV) of between 0.1 and 10.0 $h^{-1}$, preferably between 0.1 and 5.0 $h^{-1}$, preferentially between 0.2 and 2.0 $h^{-1}$, preferably between 0.2 and 1 $h^{-1}$. The hydrogen coverage in step b) is advantageously between 50 and 1000 $Nm^3$ of hydrogen per $m^3$ of fresh feedstock which feeds step a), preferably between 50 and 500 $Nm^3$ of hydrogen per $m^3$ of fresh feedstock which feeds step a), preferably between 100 and 300 $Nm^3$ of hydrogen per $m^3$ of fresh feedstock which feeds step a). The definitions of average temperature (WABT), of HSV and of hydrogen coverage correspond to those described above.

Said hydrotreatment reaction section is fed at least with said hydrogenated effluent obtained from step a) and a gas stream comprising hydrogen, advantageously into the first catalytic bed of the first functioning reactor. Optionally, the reaction section of said step b) may likewise also be fed with at least a fraction of a recycle stream advantageously obtained from step c) or from the optional step d).

Advantageously, said step b) is performed in a hydrotreatment reaction section comprising at least one, preferably between one and five, fixed-bed reactors containing n catalytic beds, n being an integer greater than or equal to one, preferably between one and ten, preferably between two and five, said bed(s) each comprising at least one and preferably not more than ten hydrotreatment catalysts. When a reactor comprises several catalytic beds, i.e. at least two, preferably between two and ten, preferably between two and five catalytic beds, said catalytic beds are preferably arranged in series in said reactor.

When step b) is performed in a hydrotreatment reaction section comprising several reactors, preferably two reactors, these reactors can operate in series and/or in parallel and/or in permutable (or PRS) mode and/or in swing mode. The various optional operating modes, PRS (or lead and lag) mode and swing mode, are well known to those skilled in the art and are advantageously defined hereinabove.

In another embodiment of the invention, said hydrotreatment reaction section comprises a single fixed-bed reactor containing n catalytic beds, n being an integer greater than or equal to one, preferably between one and ten, preferably between two and five.

In one particularly preferred embodiment, the hydrogenation reaction section of step a) comprises two reactors operating in permutable mode, followed by the hydrotreatment reaction section of step b) which comprises a single fixed-bed reactor.

Advantageously, said hydrotreatment catalyst used in said step b) may be chosen from known hydrodemetallation, hydrotreatment or silicon scavenging catalysts notably used for the treatment of petroleum cuts, and combinations thereof. Known hydrodemetallation catalysts are, for example, those described in the patents EP 0113297, EP 0113284, U.S. Pat. Nos. 5,221,656, 5,827,421, 7,119,045, 5,622,616 and 5,089,463. Known hydrotreatment catalysts are, for example, those described in the patents EP 0113297, EP 0113284, U.S. Pat. Nos. 6,589,908, 4,818,743 or 6,332,976. Known silicon scavenging catalysts are, for example, those described in the patent applications CN 102051202 and US 2007/080099.

In particular, said hydrotreatment catalyst comprises a support, preferably a mineral support, and at least one metallic element having a hydrodehydrogenating function. Said metallic element having a hydrodehydrogenating function advantageously comprises at least one group VIII element, preferably chosen from the group consisting of nickel and cobalt, and/or at least one group VI B element, preferably chosen from the group consisting of molybdenum and tungsten. The total content expressed as oxides of metallic elements from groups VIB and VIII is preferably between 0.1% and 40% by weight and preferentially from 5% to 35% by weight relative to the total weight of the catalyst. When the metal is cobalt or nickel, the metal content is expressed as CoO and NiO, respectively. When the metal is molybdenum or tungsten, the metal content is expressed as $MoO_3$ and $WO_3$, respectively. The weight ratio expressed as metal oxide between the group VIB metal(s) relative to the group VIII metal(s) is preferably between 1.0 and 20 and preferably between 2.0 and 10. For example, the hydrotreatment reaction section of step b) of the process comprises a hydrotreatment catalyst comprising between 0.5% and 10% by weight of nickel, preferably between 1% and 8% by weight of nickel, expressed as nickel oxide NiO relative to the total weight of the hydrotreatment catalyst, and between 1.0% and 30% by weight of molybdenum, preferably between 3.0% and 29% by weight of molybdenum, expressed as molybdenum oxide $MoO_3$ relative to the total weight of the hydrotreatment catalyst, on a mineral support, preferably on an alumina support.

The support for said hydrotreatment catalyst is advantageously chosen from alumina, silica, silica-aluminas, magnesia, clays and mixtures thereof. Said support may also contain dopant compounds, notably oxides chosen from boron oxide, in particular boron trioxide, zirconia, ceria, titanium oxide, phosphorus pentoxide and a mixture of these oxides. Preferably, said hydrotreatment catalyst comprises an alumina support, preferably an alumina support doped with phosphorus and optionally boron. When phosphorus pentoxide $P_2O_5$ is present, its concentration is less than 10% by weight relative to the weight of the alumina and advantageously at least 0.001% by weight relative to the total weight of the alumina. When boron trioxide $B_2O_3$ is present, its concentration is less than 10% by weight relative to the weight of the alumina and advantageously at least 0.001% relative to the total weight of the alumina. The alumina used may be, for example, a γ (gamma) or η (eta) alumina.

Said hydrotreatment catalyst is, for example, in the form of extrudates.

Advantageously, said hydrotreatment catalyst used in step b) of the process has a specific surface area of greater than or equal to 250 $m^2/g$, preferably greater than or equal to 300 $m^2/g$. The specific surface area of said hydrotreatment catalyst is advantageously less than or equal to 800 $m^2/g$, preferably less than or equal to 600 $m^2/g$, in particular less than or equal to 400 $m^2/g$. The specific surface area of the hydrotreatment catalyst is measured by the BET method, i.e. the specific surface area determined by nitrogen adsorption in accordance with the standard ASTM D 3663-78 established from the Brunauer-Emmett-Teller method described in the periodical *The Journal of the American Chemical Society,* 60, 309 (1938). Such a specific surface area makes it possible to further improve the removal of the contaminants, in particular of the metals such as silicon.

According to another aspect of the invention, the hydrotreatment catalyst as described above also comprises one or more organic compounds containing oxygen and/or nitrogen and/or sulfur. Such a catalyst is often denoted by the term "additivated catalyst". Generally, the organic compound is chosen from a compound including one or more chemical functions chosen from carboxylic, alcohol, thiol, thioether, sulfone, sulfoxide, ether, aldehyde, ketone, ester, carbonate, amine, nitrile, imide, oxime, urea and amide functions or else compounds including a furan ring or else sugars.

Advantageously, the hydrotreatment step b) allows the hydrogenation of at least 80%, and preferably all, of the olefins remaining after the hydrogenation step a), but also the at least partial conversion of other impurities present in the feedstock, such as the aromatic compounds, the metal compounds, the sulfur compounds, the nitrogen compounds, the halogen compounds (notably the chlorine compounds) and the oxygen compounds.

Preferably, the nitrogen content at the output of step b) is less than 10 ppm weight. Step b) may also make it possible to further reduce the content of contaminants, such as that of the metals, in particular the silicon content. Preferably, the metal content at the output of step b is less than 10 ppm by weight, and preferably less than 2 ppm by weight, and the silicon content is less than 5 ppm by weight.

Hydrocracking Step (Optional) b')

According to one variant, the process of the invention may comprise a hydrocracking step b') performed either directly after the hydrotreatment step b), or after the fractionation step d) on a hydrocarbon-based cut comprising compounds with a boiling point greater than 175° C. (diesel cut).

Advantageously, step b') implements hydrocracking reactions that are well known to those skilled in the art, and more particularly makes it possible to convert the heavy compounds, for example compounds with a boiling point of greater than 175° C., into compounds with a boiling point of less than or equal to 175° C. contained in the hydrotreated effluent obtained from step b) or separated during the fractionation step d). Other reactions, such as the hydrogenation of olefins or of aromatics, hydrodemetallation, hydrodesulfurization, hydrodeazotization, etc. may follow.

The compounds with a boiling point greater than 175° C. have a high BMCI and contain, relative to lighter compounds, more naphthenic, naphtheno-aromatic and aromatic compounds, thus leading to a higher C/H ratio. This high ratio is a cause of coking in the steam cracker, thus requiring steam cracking furnaces dedicated to this cut. When it is desired to minimize the yield of these heavy compounds (diesel cut) and to maximize the yield of light compounds (naphtha cut), these compounds can be at least partly converted into light compounds by hydrocracking, a cut generally favoured for a steam cracking unit.

Thus, the process of the invention can comprise a hydrocracking step b') performed in a hydrocracking reaction section, using at least one fixed bed containing n catalytic beds, n being an integer greater than or equal to 1, each comprising at least one hydrocracking catalyst, said hydrocracking reaction section being fed with said hydrotreated effluent obtained from step b) and/or with the cut comprising compounds having a boiling point greater than 175° C. obtained from step d) and a gas stream comprising hydrogen, said hydrocracking reaction section being used at an average temperature of between 250 and 450° C., a partial pressure of hydrogen of between 1.5 and 20.0 MPa abs. and an hourly space velocity of between 0.1 and 10.0 $h^{-1}$, to obtain a hydrocracked effluent which is sent to the fractionation step d).

Thus, said hydrocracking reaction section is advantageously implemented at an average temperature of between 250 and 480° C., preferably between 320 and 450° C., at a partial pressure of hydrogen of between 1.5 and 20.0 MPa abs., preferably between 2 and 18.0 MPa abs., and at an hourly space velocity (HSV) of between 0.1 and 10.0 $h^{-1}$, preferably between 0.1 and 5.0 $h^{-1}$, preferentially between 0.2 and 4 $h^{-1}$. The hydrogen coverage in step c) is advantageously between 80 and 2000 $Nm^3$ of hydrogen per $m^3$ of fresh feedstock which feeds step a), preferably between 200 and 1800 $Nm^3$ of hydrogen per $m^3$ of fresh feedstock which feeds step a). The definitions of average temperature (WABT), of HSV and of hydrogen coverage correspond to those described above.

Advantageously, said hydrocracking reaction section is implemented at a pressure equivalent to that used in the reaction section of the hydrogenation step a) or of the hydrotreatment step b).

Advantageously, said step b') is performed in a hydrocracking reaction section comprising at least one, preferably between one and five, fixed-bed reactors containing n catalytic beds, n being an integer greater than or equal to one, preferably between one and ten, preferably between two and five, said bed(s) each comprising at least one, and preferably not more than ten, hydrocracking catalysts. When a reactor comprises several catalytic beds, i.e. at least two, preferably between two and ten, preferably between two and five, catalytic beds, said catalytic beds are preferably arranged in series in said reactor.

The hydrotreatment step b) and the hydrocracking step b') may advantageously be performed in the same reactor or in different reactors. When they are performed in the same reactor, the reactor comprises several catalytic beds, the first catalytic beds comprising the hydrotreatment catalyst(s) and the following catalytic beds comprising the hydrocracking catalyst(s).

The hydrocracking step can be performed in one step (step b')) or two steps (step b') and b")). When it is performed in two steps, a separation of the effluent obtained from the first hydrocracking step b') is carried out, making it possible to obtain a cut comprising compounds with a boiling point greater than 175° C. (diesel cut) during steps c) and d), which cut is introduced into the second hydrocracking step b") comprising a dedicated second hydrocracking reaction section different from the first hydrocracking reaction section b'). This configuration is particularly suitable when it is desired to produce only a naphtha cut.

The second hydrocracking step b") performed in a hydrocracking reaction section, using at least one fixed bed containing n catalytic beds, n being an integer greater than or equal to 1, each comprising at least one hydrocracking catalyst, said hydrocracking reaction section being fed at least with the cut comprising compounds with a boiling point of greater than 175° C. obtained from the step d) and a gas stream comprising hydrogen, said hydrocracking reaction section being used at an average temperature of between 250 and 450° C., a partial pressure of hydrogen of between 1.5 and 20.0 MPa abs. and an hourly space velocity of between 0.1 and 10.0 $h^{-1}$, to obtain a hydrocracked effluent which is sent to the separation step c). The preferred operating conditions and the catalysts used in the second hydrocracking step are those described for the first hydrocracking step. The operating conditions and catalysts used in the two hydrocracking steps may be identical or different.

Said second hydrocracking step is preferably performed in a hydrocracking reaction section comprising at least one, preferably between one and five, fixed-bed reactors containing n catalytic beds, n being an integer greater than or equal to one, preferably between one and ten, preferably between two and five, said bed(s) each comprising at least one and preferably not more than ten hydrocracking catalysts.

These operating conditions used in the hydrocracking step(s) generally make it possible to obtain conversions per pass, into products having at least 80% by volume of compounds with boiling points of less than or equal to 175° C., preferably less than 160° C. and preferably less than 150° C., and greater than 15% by weight and even more preferably of between 20 and 95% by weight. When the process is performed in two hydrocracking steps, the conversion per pass in the second step is kept moderate in order to maximize the selectivity for compounds of the naphtha cut (with a boiling point of less than or equal to 175° C., in particular between 80 and less than or equal to 175° C.). The conversion per pass is limited by the use of a high recycle ratio over the second hydrocracking step loop. This ratio is defined as the ratio of the feed flow rate of step b") to the flow rate of the feedstock of step a); preferentially, this ratio is between 0.2 and 4, preferably between 0.5 and 2.5.

The hydrocracking step(s) thus does (do) not necessarily make it possible to convert all the compounds with a boiling point greater than 175° C. (diesel cut) into compounds with a boiling point of less than or equal to 175° C. (naphtha cut). After the fractionation step d), there may therefore remain a more or less significant proportion of compounds with a boiling point greater than 175° C. In order to increase the conversion, at least a part of this unconverted cut can be recycled as described below to step b') or else can be sent into a second hydrocracking step b"). Another part can be purged. Depending on the operating conditions of the process, said purge may be between 0 and 10% by weight of the cut comprising compounds with a boiling point greater than 175° C. relative to the ingoing feedstock, and preferably between 0.5% and 5% by weight.

In accordance with the invention, the hydrocracking step (s) operate(s) in the presence of at least one hydrocracking catalyst.

The hydrocracking catalyst(s) used in the hydrocracking step(s) are conventional hydrocracking catalysts known to those skilled in the art, of bifunctional type combining an acid function with a hydro-dehydrogenating function and optionally at least one binder matrix. The acid function is provided by supports having large surface areas (generally 150 to 800 $m^2/g$) having surface acidity, such as halogenated (notably chlorinated or fluorinated) aluminas, combinations of boron and aluminium oxides, amorphous silica-aluminas and zeolites. The hydro-dehydrogenating function is provided by at least one metal from group VIB of the Periodic Table and/or at least one metal from group VIII.

Preferably, the hydrocracking catalyst(s) comprise a hydro-dehydrogenating function comprising at least one metal from group VIII chosen from iron, cobalt, nickel, ruthenium, rhodium, palladium and platinum, and preferably from cobalt and nickel. Preferably, said catalyst(s) also comprise at least one metal from group VIB chosen from chromium, molybdenum and tungsten, alone or as a mixture, and preferably from molybdenum and tungsten. Hydro-dehydrogenating functions of NiMo, NiMoW or NiW type are preferred.

Preferably, the content of metal from group VIII in the hydrocracking catalyst(s) is advantageously between 0.5% and 15% by weight and preferably between 1% and 10% by weight, the percentages being expressed as weight percentage of oxides relative to the total weight of the catalyst. When the metal is cobalt or nickel, the metal content is expressed as CoO and NiO, respectively.

Preferably, the content of metal from group VIB in the hydrocracking catalyst(s) is advantageously between 5% and 35% by weight and preferably between 10% and 30% by weight, the percentages being expressed as weight percentage of oxides relative to the total weight of the catalyst. When the metal is molybdenum or tungsten, the metal content is expressed as $MoO_3$ and $WO_3$, respectively.

The hydrocracking catalyst(s) may also optionally comprise at least one promoter element deposited on the catalyst and chosen from the group formed by phosphorus, boron and silicon, optionally at least one element from group VIIA (chlorine and fluorine preferred), optionally at least one element from group VIIB (manganese preferred), and optionally at least one element from group VB (niobium preferred).

Preferably, the hydrocracking catalyst(s) comprise at least one amorphous or poorly crystallized porous mineral matrix of oxide type chosen from aluminas, silicas, silica-aluminas, aluminates, alumina-boron oxide, magnesia, silica-magnesia, zirconia, titanium oxide or clay, alone or as a mixture, and preferably aluminas or silica-aluminas, alone or as a mixture.

Preferably, the silica-alumina contains more than 50% by weight of alumina, preferably more than 60% by weight of alumina.

Preferably, the hydrocracking catalyst(s) also optionally comprise a zeolite chosen from Y zeolites, preferably from USY zeolites, alone or in combination with other zeolites from among beta, ZSM-12, IZM-2, ZSM-22, ZSM-23, SAPO-11, ZSM-48 or ZBM-30 zeolites, alone or as a mixture. Preferably, the zeolite is USY zeolite alone.

When said catalyst comprises a zeolite, the content of zeolite in the hydrocracking catalyst(s) is advantageously between 0.1% and 80% by weight, preferably between 3% and 70% by weight, the percentages being expressed as a percentage of zeolite relative to the total weight of the catalyst.

A preferred catalyst comprises, and preferably consists of, at least one metal from group VIB and optionally at least one non-noble metal from group VIII, at least one promoter element, and preferably phosphorus, at least one Y zeolite and at least one alumina binder.

An even more preferred catalyst comprises, and preferably consists of, nickel, molybdenum, phosphorus, a USY zeolite, and optionally also a beta zeolite, and alumina.

Another preferred catalyst comprises, and preferably consists of, nickel, tungsten, alumina and silica-alumina.

Another preferred catalyst comprises, and preferably consists of, nickel, tungsten, a USY zeolite, alumina and silica-alumina.

Said hydrocracking catalyst is, for example, in the form of extrudates.

In one variant, the hydrocracking catalyst used in step b") comprises a hydro-dehydrogenating function comprising at least one noble metal from group VIII chosen from palladium and platinum, alone or as a mixture. The content of noble metal from group VIII is advantageously between 0.01% and 5% by weight and preferably between 0.05% and 3% by weight, the percentages being expressed as weight percentage of oxides (PtO or PdO) relative to the total weight of catalyst.

According to another aspect of the invention, the hydrocracking catalyst as described above also comprises one or more organic compounds containing oxygen and/or nitrogen and/or sulfur. Such a catalyst is often denoted by the term "additivated catalyst". Generally, the organic compound is chosen from a compound including one or more chemical functions chosen from carboxylic, alcohol, thiol, thioether, sulfone, sulfoxide, ether, aldehyde, ketone, ester, carbonate, amine, nitrile, imide, oxime, urea and amide functions or else compounds including a furan ring or else sugars.

The preparation of the catalysts for steps a), b), b') or b") is known and generally comprises a step of impregnation of the group VIII metals and of the group VIB metals when present, and optionally of the phosphorus and/or boron on the support, followed by drying, and then optionally calcining. In the case of an additivated catalyst, the preparation generally takes place by simple drying without calcining after introducing the organic compound. The term "calcining" means herein a heat treatment under a gas containing air or oxygen at a temperature of greater than or equal to 200° C. Before their use in a process step, the catalysts are generally subjected to sulfurization so as to form the active species. The catalyst of step a) may also be a catalyst used in its reduced form, thus involving a reduction step in its preparation.

The gas stream comprising hydrogen, which feeds the reaction section of step a), b), b') or b") may consist of a supply of hydrogen and/or of recycled hydrogen obtained in particular from the separation step c). Preferably, an additional gas stream comprising hydrogen is advantageously introduced into the inlet of each reactor, in particular operating in series, and/or into the inlet of each catalytic bed from the second catalytic bed of the reaction section. These additional gas streams are also referred to as cooling streams. They make it possible to control the temperature in the reactor in which the reactions involved are generally highly exothermic.

Optionally, each of steps a), b), b') or b") can use a heating section located upstream of the reaction section and in which the ingoing effluent is heated so as to reach a suitable temperature. Said optional heating section can thus comprise one or more exchangers preferably allowing heat exchange between the hydrotreated effluent and the hydrocracked effluent, and/or a preheating oven.

However, the performing of step a) at a relatively high average temperature with an increasing profile optionally makes it possible to eliminate the need for a heating device or at least to reduce the heat requirement between the hydrogenation catalytic section of step a) and the hydrotreatment catalytic section of step b).

Separation Step c)

According to the invention, the treatment process comprises a separation step c), advantageously performed in at least one washing/separation section, fed at least with the hydrotreated effluent obtained from step b), or the hydrocracked effluent obtained from optional steps b') and b"), and an aqueous solution, to obtain at least one gaseous effluent, an aqueous effluent and a hydrocarbon-based effluent.

The gaseous effluent obtained on conclusion of step c) advantageously comprises hydrogen, preferably comprises at least 80% by volume, preferably at least 85% by volume, of hydrogen. Advantageously, said gaseous effluent may be at least partly recycled to the hydrogenation step a) and/or the hydrotreatment step b) and/or the hydrocracking step b') and/or the hydrocracking step b"), the recycling system possibly comprising a purification section.

The aqueous effluent obtained on conclusion of step c) advantageously comprises ammonium salts and/or hydrochloric acid.

This separation step c) in particular makes it possible to remove the ammonium chloride salts which form by reaction between the chloride ions, released by hydrogenation of the chlorinated compounds in HCl form notably during steps a) and b) followed by dissolution in the water, and the ammonium ions, generated by hydrogenation of the nitrogenous compounds in the form of $NH_3$ notably during step b) and/or provided by injection of an amine followed by dissolution in the water, and thus to limit the risks of clogging, in particular in the transfer lines and/or in the sections of the process of the invention and/or the transfer lines to the steam cracker, due to the precipitation of the ammonium chloride salts. It also makes it possible to remove the hydrochloric acid formed by the reaction of the hydrogen ions and the chloride ions.

As a function of the content of chlorinated compounds in the initial feedstock to be treated, a stream containing an amine, for instance monoethanolamine, diethanolamine and/or monodiethanolamine, may be injected upstream of the hydrogenation step a) and/or between the hydrogenation step a) and the hydrotreatment step b) and/or between the hydrocracking step b') and the separation step c), preferably upstream of the hydrogenation step a), so as to ensure a sufficient amount of ammonium ions to combine with the chloride ions formed during the hydrotreatment step, thus making it possible to limit the formation of hydrochloric acid and thus to limit corrosion downstream of the separation section.

Advantageously, the separation step c) comprises injection of an aqueous solution, preferably injection of water, into the hydrotreated effluent obtained from step b), or the hydrocracked effluent obtained from the optional steps b') and b"), upstream of the washing/separation section, so as to at least partly dissolve the ammonium chloride salts and/or the hydrochloric acid and thus to improve the removal of the chlorinated impurities and to reduce the risks of clogging caused by accumulation of the ammonium chloride salts.

The separation step c) is advantageously carried out at a temperature between 50 and 450° C., preferentially between 100 and 440° C., preferably between 200 and 420° C. It is important to carry out said step in this temperature range (and therefore not to cool the hydroconverted effluent too much) at the risk of blocking in the lines due to the precipitation of the ammonium chloride salts. Advantageously, the separation step c) is carried out at a pressure close to that used in steps a) and/or b), preferably between 1.0 and 20.0 MPa, so as to facilitate the recycling of hydrogen.

The washing/separation section of step c) may be at least partly performed in common or separate washing and separation equipment, this equipment being well known (separating vessels which may be operated at various pressures and temperatures, pumps, heat exchangers, washing columns, etc.).

In one optional embodiment of the invention, the separation step c) comprises the injection of an aqueous solution into the hydrotreated effluent obtained from step b), followed by the washing/separation section advantageously comprising a separation phase for obtaining at least one aqueous effluent charged with ammonium salts, a washed liquid hydrocarbon-based effluent and a partially washed gaseous effluent. The aqueous effluent charged with ammonium salts and the washed liquid hydrocarbon-based effluent may subsequently be separated in a decanting vessel so as to obtain said hydrocarbon-based effluent and said aqueous effluent. Said partially washed gaseous effluent may, in parallel, be introduced into a washing column where it circulates counter-currentwise relative to an aqueous stream, preferably of the same nature as the aqueous solution injected into the hydrotreated effluent, which makes it possible to at least partly, and preferably totally, remove the hydrochloric acid contained in the partially washed gaseous effluent and thus to obtain said gaseous effluent, preferably essentially comprising hydrogen, and an acidic aqueous stream. Said aqueous effluent obtained from the decanting vessel may optionally be mixed with said acidic aqueous stream, and be used, optionally as a mixture with said acidic aqueous stream, in a water recycling circuit to feed step c) of separation into said aqueous solution upstream of the washing/separation section and/or into said aqueous stream in the washing column. Said water recycling circuit may include a supply of water and/or of a basic solution and/or a purge for removing the dissolved salts.

In another optional embodiment of the invention, the separation step c) may advantageously comprise a "high-pressure" washing/separation section which operates at a pressure close to the pressure of the hydrogenation step a) and/or of the hydrotreatment step b) and/or of the optional hydrocracking step b'), preferably between 1.0 and 20.0 MPa, so as to facilitate the recycling of hydrogen. This optional "high-pressure" section of step c) may be completed with a "low-pressure" section, so as to obtain a hydrocarbon-based liquid fraction free of a portion of the gases dissolved at high pressure and intended to be treated directly in a steam cracking process or optionally to be sent into the fractionation step d).

The gas fraction(s) obtained from the separation step c) may undergo additional purification(s) and separation(s) for the purpose of recovering at least one hydrogen-rich gas which may be recycled upstream of steps a) and/or b) and/or b') and/or b") and/or light hydrocarbons, notably ethane, propane and butane, which may advantageously be sent separately or as a mixture into one or more furnaces of the steam cracking step e) so as to increase the overall yield of olefins.

The hydrocarbon-based effluent obtained from the separation step c) is sent, partly or totally, either directly to the inlet of a steam cracking unit, or into an optional fractionation step d). Preferably, the hydrocarbon-based liquid effluent is sent, partly or totally, preferably totally, into a fractionation step d).

Fractionation Step d) (Optional)

The process according to the invention may comprise a step of fractionating all or a portion, preferably all, of the hydrocarbon-based effluent obtained from step c), to obtain at least one gas stream and at least two liquid hydrocarbon-based streams, said two liquid hydrocarbon-based streams being at least one naphtha cut comprising compounds with a boiling point of less than or equal to 175° C., in particular between 80 and 175° C., and one hydrocarbon cut comprising compounds with a boiling point of greater than 175° C.

Step d) makes it possible in particular to remove the gases dissolved in the hydrocarbon-based liquid effluent, for instance ammonia, hydrogen sulfide and light hydrocarbons containing 1 to 4 carbon atoms.

The optional fractionation step d) is advantageously performed at a pressure of less than or equal to 1.0 MPa abs., preferably between 0.1 and 1.0 MPa abs.

According to one embodiment, step d) may be performed in a section advantageously comprising at least one stripping column equipped with a reflux circuit comprising a reflux vessel. Said stripping column is fed with the hydrocarbon-based liquid effluent obtained from step c) and with a steam stream. The hydrocarbon-based liquid effluent obtained from step c) may optionally be heated before entering the stripping column. Thus, the lightest compounds are entrained to the top of the column and into the reflux circuit comprising a reflux vessel in which a gas/liquid separation is performed. The gaseous phase which comprises the light hydrocarbons is withdrawn from the reflux vessel as a gas stream. The naphtha cut comprising compounds with a boiling point of less than or equal to 175° C. is advantageously withdrawn from the reflux vessel. The hydrocarbon cut comprising compounds with a boiling point of greater than 175° C. is advantageously withdrawn at the bottom of the stripping column.

According to other embodiments, the fractionation step d) may involve a stripping column followed by a distillation column or only a distillation column.

The naphtha cut comprising compounds with a boiling point of less than or equal to 175° C. and the cut comprising compounds with a boiling point of greater than 175° C., which are optionally mixed, may be sent, totally or partly, to a steam cracking unit, at the outlet of which olefins may be (re)formed to participate in the formation of polymers. Preferably, only a portion of said cuts is sent to a steam cracking unit; at least a fraction of the remaining portion is optionally recycled into at least one of the steps of the process and/or sent to a fuel storage unit, for example a naphtha storage unit, a diesel storage unit or a kerosene storage unit, obtained from conventional petroleum-based feedstocks.

According to a preferred embodiment, the naphtha cut comprising compounds with a boiling point of less than or equal to 175° C. is sent, totally or partly, to a steam cracking unit, whereas the cut comprising compounds with a boiling point of greater than 175° C. is recycled into step a) and/or b) and/or b'), and/or sent to a fuel storage unit.

In one particular embodiment, the optional fractionation step d) may make it possible to obtain, besides a gas stream, a naphtha cut comprising compounds with a boiling point of less than or equal to 175° C., preferably between 80 and 175° C., and a middle distillates cut comprising compounds with a boiling point of greater than 175° C. and less than 385° C., and a hydrocarbon cut comprising compounds with a boiling point of greater than or equal to 385° C., known as heavy hydrocarbon cut. The naphtha cut may be sent, totally or partly, to a steam cracking unit and/or to the storage unit for naphtha obtained from conventional petroleum-based feedstocks; it may also be recycled; the middle distillates cut may also be sent, totally or partly, either to a steam cracking unit, or to a storage unit for diesel obtained from conventional petroleum-based feedstocks, or may be recycled; the heavy cut may, for its part, be sent, at least partly, to a steam cracking unit, or may be recycled.

In another particular embodiment, the optional fractionation step e) may make it possible to obtain, besides a gas stream, a naphtha cut comprising compounds with a boiling point of less than or equal to 175° C., preferably between 80 and 175° C., and a kerosene cut comprising compounds with a boiling point of greater than 175° C. and less than or equal to 280° C., a diesel cut comprising compounds with a boiling point of greater than 280° C. and less than 385° C., and a hydrocarbon cut comprising compounds with a boiling point of greater than or equal to 385° C., known as the heavy hydrocarbon cut. The naphtha cut may be sent, totally or partly, to a steam cracking unit and/or to the naphtha pool obtained from conventional petroleum-based feedstocks; it may also be sent into the recycling step g); the kerosene cut and/or the diesel cut may also be sent, totally or partly, either to a steam cracking unit, or respectively to a kerosene or diesel pool obtained from conventional petroleum-based feedstocks, or sent into the recycling step f); the heavy cut may, for its part, be sent, at least partly, to a steam cracking unit, or may be sent into the recycling step f).

In another particular embodiment, the naphtha cut comprising compounds with a boiling point of less than or equal to 175° C. obtained from step d) is fractionated into a heavy naphtha cut comprising compounds with a boiling point of between 80 and 175° C. and a light naphtha cut comprising compounds with a boiling point of less than 80° C., at least a portion of said heavy naphtha cut being sent into an aromatic complex including at least one naphtha reforming step for the purpose of producing aromatic compounds. According to this embodiment, at least a portion of the light naphtha cut is sent into the steam cracking step e) described below.

The gas fraction(s) obtained from the fractionation step d) may undergo additional purification(s) and separation(s) for the purpose of recovering at least light hydrocarbons, notably ethane, propane and butane, which may advantageously be sent separately or as a mixture into one of the furnaces of the steam cracking step e) so as to increase the overall yield of olefins.

Recycling of the Cut Comprising Compounds with a Boiling Point of Greater than 175° C.

At least one fraction of the cut comprising compounds with a boiling point of greater than 175° C. obtained from the fractionation step d) can be recovered to constitute a recycle stream which is sent upstream of or directly into at least one of the reaction steps of the process according to the invention, in particular into the hydrogenation step a) and/or the hydrotreatment step b) and/or the hydrocracking step b'). Optionally, a fraction of the recycle stream may be sent into the optional step a0).

The recycle stream may feed said reaction steps a) and/or b) and/or b') in a single injection or may be divided into several fractions to feed the reaction steps a) and/or b) and/or b') in several injections, i.e. into different catalytic beds.

Advantageously, the amount of the recycle stream of the cut comprising compounds with a boiling point of greater than 175° C. is adjusted so that the weight ratio between the recycle stream and the feedstock comprising a plastics pyrolysis oil, i.e. the feedstock to be treated feeding the overall process, is less than or equal to 10, preferably less than or equal to 5, and preferentially greater than or equal to 0.001, preferably greater than or equal to 0.01, and preferably greater than or equal to 0.1. Very preferably, the amount of the recycle stream is adjusted so that the weight ratio between the recycle stream and the feedstock comprising a plastics pyrolysis oil is between 0.2 and 5.

According to one preferred variant, at least a fraction of the cut comprising compounds with a boiling point of greater than 175° C. obtained from the fractionation step d) is sent into the hydrocracking step b') when it is present. The recycling of a portion of the cut comprising compounds with a boiling point of greater than 175° C. into or upstream of at least one of the reaction steps of the process according to the invention, and notably into the hydrocracking step b'), advantageously makes it possible to increase the yield of naphtha cut with a boiling point of less than 175° C. The recycling also makes it possible to dilute the impurities and moreover to control the temperature in the reaction step(s) in which the reactions involved may be highly exothermic.

According to another preferred variant, at least a fraction of the cut comprising compounds with a boiling point of greater than 175° C. obtained from the fractionation step d) is sent into a second hydrocracking step b") when it is present.

A purge may be installed on the recycling of the cut comprising compounds with a boiling point of greater than 175° C. Depending on the operating conditions of the process, said purge may be between 0 and 10% by weight of the cut comprising compounds with a boiling point of greater than 175° C. relative to the entering feedstock, and preferably between 0.5% and 5% by weight.

Recycling of the Hydrocarbon-Based Effluent Obtained from Step c) and/or of the Naphtha Cut with a Boiling Point of Less than or Equal to 175° C. Obtained from Step d)

A fraction of the hydrocarbon-based effluent obtained from the separation step c) or a fraction of the naphtha cut with a boiling point of less than or equal to 175° C. obtained from the optional fractionation step d) may be recovered to constitute a recycle stream which is sent upstream of or directly into at least one of the reaction steps of the process according to the invention, in particular into the hydrogenation step a) and/or the hydrotreatment step b). Optionally, a fraction of the recycle stream may be sent into the optional pretreatment step a0).

Preferably, at least a fraction of the hydrocarbon-based effluent obtained from the separation step c) or of the naphtha cut with a boiling point of less than or equal to 175° C. obtained from the optional fractionation step d) feeds the hydrotreatment step b).

Advantageously, the amount of the recycle stream, i.e. the fraction of recycled product obtained, is adjusted so that the weight ratio between the recycle stream and the feedstock comprising a plastics pyrolysis oil, i.e. the feedstock to be treated feeding the overall process, is less than or equal to 10, preferably less than or equal to 5, and preferentially greater than or equal to 0.001, preferably greater than or equal to 0.01, and preferably greater than or equal to 0.1. Very preferably, the amount of the recycle stream is adjusted so that the weight ratio between the recycle stream and the feedstock comprising a plastics pyrolysis oil is between 0.2 and 5.

Advantageously, for the starting phases of the process, a hydrocarbon cut external to the process may be used as recycle stream. Those skilled in the art will then know how to choose said hydrocarbon cut.

The recycling of a portion of the product obtained into or upstream of at least one of the reaction steps of the process according to the invention advantageously makes it possible, firstly, to dilute the impurities and, secondly, to control the temperature in the reaction step(s) in which the reactions involved may be highly exothermic.

Said hydrocarbon-based effluent or said hydrocarbon-based stream(s) thus obtained by treatment according to the process of the invention of a plastics pyrolysis oil has (have) a composition that is compatible with the specifications for a feedstock entering a steam cracking unit. In particular, the composition of the hydrocarbon-based effluent or of said hydrocarbon-based stream(s) is preferably such that:

- the total content of metallic elements is less than or equal to 5.0 ppm by weight, preferably less than or equal to 2.0 ppm by weight, preferentially less than or equal to 1.0 ppm by weight and preferably less than or equal to 0.5 ppm by weight, with:
  - a content of silicon element (Si) of less than or equal to 1.0 ppm by weight, preferably less than or equal to 0.6 ppm by weight, and
  - a content of iron element (Fe) of less than or equal to 100 ppb by weight,
- the sulfur content is less than or equal to 500 ppm by weight, preferably less than or equal to 200 ppm by weight,
- the nitrogen content is less than or equal to 100 ppm by weight, preferably less than or equal to 50 ppm by weight and preferably less than or equal to 5 ppm by weight,
- the content of asphaltenes is less than or equal to 5.0 ppm by weight,
- the total content of chlorine element is less than or equal to 10 ppm by weight, preferably less than 1.0 ppm by weight,
- the content of olefinic compounds (monoolefins and diolefins) is less than or equal to 5.0% by weight, preferably less than or equal to 2.0% by weight and preferably less than or equal to 0.1% by weight.

The contents are given as relative weight concentrations, weight percentages (%), parts per million (ppm) by weight or parts per billion (ppb) by weight, relative to the total weight of the stream under consideration.

The process according to the invention thus makes it possible to treat the plastics pyrolysis oils to obtain an effluent which can be totally or partly injected into a steam cracking unit.

Step e) of Steam Cracking (Optional)

The hydrocarbon-based effluent obtained from the separation step c), or at least one of the two liquid hydrocarbon-based streams obtained from the optional step d), may be totally or partly sent to a steam cracking step e).

Advantageously, the gas fraction(s) obtained from the separation step c) and/or the fractionation step d) and containing ethane, propane and butane may also be totally or partly sent to the steam cracking step e).

Said steam cracking step e) is advantageously performed in at least one pyrolysis furnace at a temperature of between 700 and 900° C., preferably between 750 and 850° C., and at a pressure of between 0.05 and 0.3 MPa relative. The residence time of the hydrocarbon-based compounds is generally less than or equal to 1.0 second (noted as s), preferably between 0.1 and 0.5 s. Steam is advantageously introduced upstream of the optional steam cracking step e) and after the separation (or the fractionation). The amount of water introduced, advantageously in the form of steam, is advantageously between 0.3 and 3.0 kg of water per kg of hydrocarbon-based compounds entering step e). The optional step e) is preferably performed in a plurality of pyrolysis furnaces in parallel, so as to adapt the operating conditions to the various streams feeding step e) and notably obtained from step d), and also to manage the tube decoking times. A furnace comprises one or more tubes arranged in parallel. A furnace may also denote a group of furnaces operating in parallel. For example, a furnace may be dedicated to the cracking of the naphtha cut comprising compounds with a boiling point of less than or equal to 175° C.

The effluents from the various steam cracking furnaces are generally recombined before separation so as to constitute an effluent. It is understood that the steam cracking step e) includes the steam cracking furnaces but also the substeps associated with the steam cracking that are well known to those skilled in the art. These substeps may notably include heat exchangers, columns and catalytic reactors and recycling into the furnaces. A column generally makes it possible to fractionate the effluent for the purpose of recovering at least one light fraction comprising hydrogen and compounds containing 2 to 5 carbon atoms, and a fraction comprising pyrolysis gasoline, and optionally a fraction comprising pyrolysis oil. Columns make it possible to separate the various constituents of the fractionation light fraction so as to recover at least one cut rich in ethylene (C2 cut) and a cut rich in propylene (C3 cut) and optionally a cut rich in butenes (C4 cut). The catalytic reactors notably make it possible to perform hydrogenations of the C2, C3 or even C4 cuts and of the pyrolysis gasoline. The saturated compounds, notably the saturated compounds containing 2 to 4 carbon atoms, are advantageously recycled into the steam cracking furnaces so as to increase the overall yields of olefins.

This steam cracking step e) makes it possible to obtain at least one effluent containing olefins comprising 2, 3 and/or 4 carbon atoms (i.e. C2, C3 and/or C4 olefins), in satisfactory contents, in particular greater than or equal to 30% by weight, notably greater than or equal to 40% by weight, or even greater than or equal to 50% by weight of total olefins comprising 2, 3 and 4 carbon atoms relative to the weight of the steam cracking effluent under consideration. Said C2, C3 and C4 olefins may then be advantageously used as polyolefin monomers.

According to one preferred embodiment of the invention, the process for treating a feedstock comprising a plastics pyrolysis oil comprises, preferably consists of, the sequence of the steps as follows, and preferably in the order given:

- hydrogenation step a), hydrotreatment step b), separation step c), or
- hydrogenation step a), hydrotreatment step b), separation step c) and fractionation step d), or
- hydrogenation step a), hydrotreatment step b), separation step c), fractionation step d) and recycling of the cut comprising compounds with a boiling point of less than or equal to 175° C. to step a) and/or b),
- hydrogenation step a), hydrotreatment step b), hydrocracking step b'), separation step c), or
- hydrogenation step a), hydrotreatment step b), hydrocracking step b'), separation step c) and fractionation step d), or
- hydrogenation step a), hydrotreatment step b), hydrocracking step b'), separation step c), fractionation step d) and recycling of the cut comprising compounds with a boiling point of greater than 175° C. to the hydrocracking step b'), or
- hydrogenation step a), hydrotreatment step b), hydrocracking step b'), separation step c), fractionation step d) and recycling of the cut comprising compounds with a boiling point of less than or equal to 175° C. to step a) or b), or hydrogenation step a), hydrotreatment step b), hydrocracking step b'), separation step c), fractionation step d), recycling of the cut comprising compounds with a boiling point of greater than 175° C. to the hydrocracking step b') and recycling of the cut comprising compounds with a boiling point of less than or equal to 175° C. to step a) or b), or hydrogenation step a), hydrotreatment step b), hydrocracking step b'), separation step c), fractionation step d) and recycling of the cut comprising compounds with a boiling point of greater than 175° C. to the hydrocracking step b"), or hydrogenation step a), hydrotreatment step b), hydrocracking step b'), separation step c), fractionation step d), recycling of the cut comprising compounds with a boiling point of greater than 175° C. to the hydrocracking step b") and recycling of the cut comprising compounds with a boiling point of less than or equal to 175° C. to step a) or b), or hydrogenation step a), hydrotreatment step b), separation step c), fractionation step d) and hydrocracking step b'), or hydrogenation step a), hydrotreatment step b), separation step c), fractionation step d) and hydrocracking step b') and recycling of the effluent from step b') into step c), or hydrogenation step a), hydrotreatment step b), separation step c), fractionation step d) and hydrocracking step b') and recycling of the effluent from step b') into step c), and recycling of the cut comprising compounds with a boiling point of less than or equal to 175° C. to step a) or b).

All the embodiments can comprise, and preferably consist of, in addition, a pretreatment step a0.

All the embodiments can comprise, and preferably consist of, in addition, a steam cracking step g).

Analysis Methods Used

The analysis methods and/or standards used for determining the characteristics of the various streams, in particular of the feedstock to be treated and of the effluents, are known to those skilled in the art. They are in particular listed below by way of information. Other reputed equivalent methods can also be used, notably equivalent IP, EN or ISO methods:

TABLE 1

| Description | Methods |
|---|---|
| Density @15° C. | ASTM D4052 |
| Sulfur Content | ISO 20846 |
| Nitrogen Content | ASTM D4629 |
| Acid number | ASTM D664 |
| Bromine Number | ASTM D1159 |
| Diolefin content based on the Maleic anhydride value | MAV method (1) |
| Oxygenated molecule content | Combustion + Infrared |
| Paraffin Content | UOP990-11 |
| Naphthene and Olefin Content | UOP990-11 |
| Aromatics Content | UOP990-11 |
| Halogen Content | ASTM D7359 |
| Chloride Content | ASTM D7536 |
| Metal Content: | ASTM D5185 |
| P | |
| Fe | |
| Si | |
| Na | |
| B | |
| Simulated distillation | ASTM D2887 |

(1) MAV method described in the article: C. López-Garcia et al., Near Infrared Monitoring of Low Conjugated Diolefins Content in Hydrotreated FCC Gasoline Streams, Oil & Gas Science and Technology—Rev. IFP, Vol. 62 (2007), No. 1, pp. 57-68

BRIEF DESCRIPTION OF THE DRAWINGS

The information regarding the elements referenced in FIGS. 1 to 2 enables a better understanding of the invention, without said invention being limited to the particular embodiments illustrated in FIGS. 1 to 2. The various embodiments presented may be used alone or in combination with each other, without any limitation to the combination.

Figure 1:
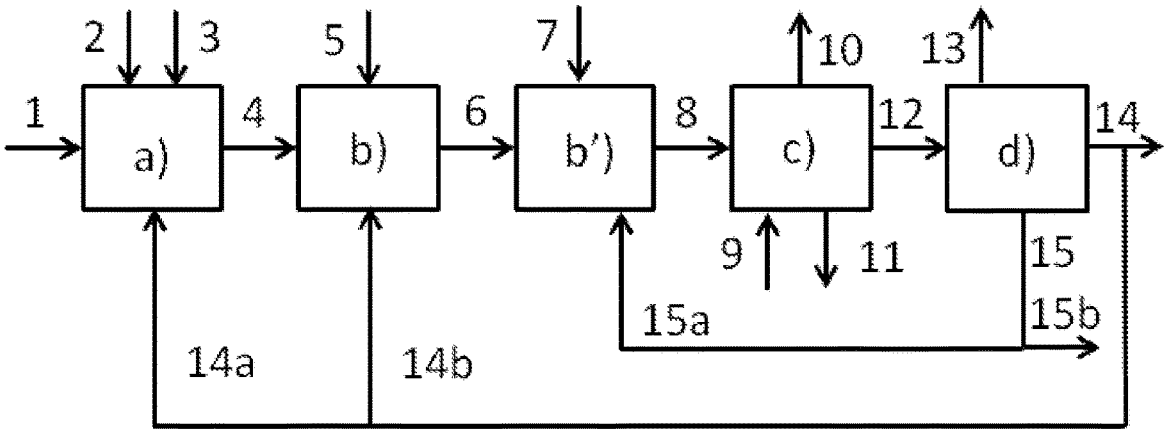
FIG. 1 represents the scheme of a particular embodiment of the process of the present invention, comprising.

a step a) of hydrogenation of a hydrocarbon-based feedstock obtained from the pyrolysis of plastics 1, in the presence of a hydrogen-rich gas 2 and optionally of an amine supplied by the stream 3, performed in at least one fixed-bed reactor including at least one hydrogenation catalyst, to obtain an effluent 4;

a step b) of hydrotreatment of the effluent 4 obtained from step a), in the presence of hydrogen 5, performed in at least one fixed-bed reactor including at least one hydrotreatment catalyst, to obtain a hydrotreated effluent 6;

optionally a step b') of hydrocracking of the effluent 6 obtained from step b), in the presence of hydrogen 7, performed in at least one fixed-bed reactor including at least one hydrocracking catalyst, to obtain a hydrocracked effluent 8;

a step c) of separation of the effluent 8 performed in the presence of an aqueous washing solution 9, making it possible to obtain at least one fraction 10 comprising hydrogen, an aqueous fraction 11 containing dissolved salts, and a hydrocarbon-based liquid fraction 12;

optionally a step d) of fractionation of the hydrocarbon-based liquid fraction 12, making it possible to obtain at least one gas fraction 13, a cut 14 comprising compounds with a boiling point of less than or equal to 175° C. (naphtha cut) and a cut 15 comprising compounds with a boiling point of greater than 175° C. (diesel cut).

At the outcome of step d), a portion of the cut 14 comprising compounds with a boiling point of less than or equal to 175° C. is sent to a steam cracking process (not represented). Another portion of the cut 14 feeds the hydrogenation step a) (fraction 14*a*) and the hydrotreatment step b) (fraction 14*b*). A portion of the cut 15 comprising compounds with a boiling point of greater than 175° C. obtained from step d) feeds the hydrocracking step b') (fraction 15*a*), another portion 15*b* constitutes the purge.

Figure 2:
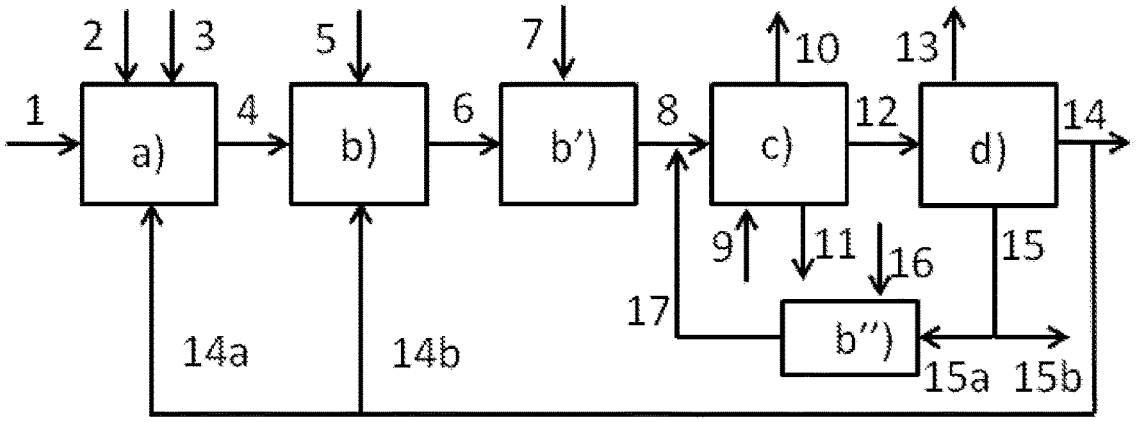

FIG. 2 represents the scheme of another particular embodiment of the process of the present invention, which is based on the scheme of FIG. 1. This scheme comprises notably a second hydrocracking step b") in which the cut 15 comprising compounds with a boiling point of greater than 175° C. obtained from step d) feeds this second hydrocracking step b") (fraction 15*a*) which is carried out in at least one fixed-bed reactor comprising at least one hydrocracking catalyst and is fed with hydrogen (16). The second hydrocracked effluent (17) is recycled into the separation step c). The other portion of the cut 15 constitutes the purge 15*b*.

Instead of injecting the amine stream 3 into the inlet of the hydrogenation step a), it is possible to inject it into the inlet of the hydrotreatment step b), into the inlet of the hydrocracking step U), into the inlet of the separation step c) or else not to inject it, depending on the characteristics of the feedstock.

Only the main steps, with the main streams, are shown in FIGS. 1 and 2, so as to allow a better understanding of the invention. It is clearly understood that all the equipment required for the functioning is present (vessels, pumps, exchangers, furnaces, columns, etc.), even if it is not shown. It is also understood that hydrogen-rich gas streams (supply or recycle), as described above, may be injected into the inlet of each reactor or catalytic bed or between two reactors or two catalytic beds. Means well known to those skilled in the art for purifying and for recycling hydrogen may also be used.

EXAMPLES

Example 1 (in Accordance with the Invention)

The feedstock 1 treated in the process is a plastics pyrolysis oil (i.e. comprising 100% by weight of said plastics pyrolysis oil) having the characteristics indicated in Table 2.

TABLE 2 feedstock characteristics

| Description/ | Methods | Unit | Pyrolysis oil |
|---|---|---|---|
| Density @15° C. | ASTM D4052 | g/cm$^3$ | 0.820 |
| Sulfur content | ISO 20846 | ppm by weight | 2500 |
| Nitrogen content | ASTM D4629 | ppm by weight | 730 |
| Acid number | ASTM D664 | mgKOH/g | 1.5 |
| Bromine Content | ASTM D1159 | g/100 g | 80 |
| Diolefin Content based on the Maleic Anhydride value | MAV Method[(1)] | % by weight | 10 |
| Oxygen molecule Content | Combustion + Infrared | % by weight | 1.0 |
| Paraffin Content | UOP990-11 | % by weight | 45 |
| Naphthene Content | UOP990-11 | % by weight | 20 |
| Olefin Content | UOP990-11 | % by weight | 25 |
| Aromatics Content | UOP990-11 | % by weight | 10 |
| Halogen Content | ASTM-D7359 | ppm by weight | 350 |
| Asphaltene Content | IFP9313 | ppm by weight | 380 |
| Chloride Content | ASTM D7536 | ppm by weight | 320 |
| Metal content: | ASTM-D5185 | | |
| P | | ppm by weight | 10 |
| Fe | | ppm by weight | 25 |
| Si | | ppm by weight | 45 |
| Na | | ppm by weight | 2 |
| B | | ppm by weight | 2 |
| Simulated Distillation: | ASTM D2887 | | |
| 0% | | | 40 |
| 10% | | | 98 |
| 30% | | | 161 |
| 50% | | | 232 |
| 70% | | | 309 |
| 90% | | | 394 |
| 100% | | | 432 |

[(1)]MAV method described in the article: C. López-Garcia et al., Near Infrared Monitoring of Low Conjugated Diolefins Content in Hydrotreated FCC Gasoline Streams, Oil & Gas Science and Technology—Rev. IFP, Vol. 62 (2007), No. 1, pp. 57-68

The feedstock 1 is subjected to a hydrogenation step a) performed in a fixed-bed reactor and in the presence of hydrogen 2 and of a hydrogenation catalyst of NiMo type on alumina, under the conditions indicated in Table 3.

TABLE 3 conditions of the hydrogenation step a)

| | | |
|---|---|---|
| Reactor inlet temperature | ° C. | 280 |
| Reactor outlet temperature | ° C. | 310 |
| Average temperature (WABT) | ° C. | 295 |
| Partial pressure of hydrogen | MPa abs | 6.4 |
| $H_2$/HC (volume coverage of hydrogen relative to the feedstock volume) | Nm$^3$/m$^3$ | 300 |
| HSV (volume flow rate of feedstock/volume of catalysts) | h$^{-1}$ | 1.0 |

The conditions indicated in Table 3 correspond to conditions at the start of the cycle and the average temperature (WABT) is increased by 1° C. per month so as to compensate for the catalytic deactivation.

At the outcome of the hydrogenation step a), the degrees of conversion (=(initial concentration final concentration)/initial concentration) observed are indicated in Table 4.

TABLE 4 conversions of the entities during the hydrogenation step a)

| | | |
|---|---|---|
| Degree of diolefin conversion | % | >60 |
| Degree of olefin conversion | % | >60 |
| Retention of silicon | % | >75 |

The effluent 4 obtained from the hydrogenation step a) is subjected directly, without separation, to a hydrotreatment step b) performed in a fixed bed and in the presence of hydrogen 5 and of a hydrotreatment catalyst of NiMo type on alumina under the conditions presented in Table 5.

TABLE 5 conditions of the hydrotreatment step b)

| | | |
|---|---|---|
| Hydrotreatment average temperature (WABT) | ° C. | 355 |
| Partial pressure of hydrogen | MPa abs | 6.2 |
| $H_2$/HC (volume coverage of hydrogen relative to the feedstock volume) | Nm$^3$/m$^3$ | 300 |
| HSV (volume flow rate of feedstock/volume of catalysts) | h$^{-1}$ | 0.5 |

The conditions indicated in Table 5 correspond to conditions at the start of the cycle and the average temperature (WABT) is increased by 1° C. per month so as to compensate for the catalytic deactivation.

The effluent 6 obtained from the hydrotreatment step b) is subjected to a separation step c): a stream of water is injected into the effluent obtained from the hydrotreatment step b); the mixture is then treated in an acid gas washing column and separating vessels so as to obtain a gas fraction and a liquid effluent. The yields for the various fractions obtained after separation are indicated in Table 6 (the yields correspond to the ratios of the mass amounts of the various products obtained relative to the mass of feedstock upstream of step a), expressed in percentage and noted as % m/m).

TABLE 6 yields of the various products obtained after separation

| | | |
|---|---|---|
| Gas fraction ($NH_3$ + $H_2S$ + C1-C4) | % m/m | 0.94 |
| Liquid fraction | % m/m | 99.41 |

All or part of the liquid fraction obtained can then be upgraded in a steam cracking step for the purpose of forming olefins which may be polymerized for the purpose of forming recycled plastics.

The process carried out according to the invention results in reduced catalytic deactivations during the hydrogenation step a) and during the hydrotreatment step b) relative to the catalytic deactivations observed according to the prior art.

Example 2 (not in Accordance with the Invention)

In this example according to the prior art and not in accordance with the invention, the feedstock to be treated is identical to that described in Example 1 (cf. Table 2).

The feedstock is subjected to a selective hydrogenation step a) performed in a fixed-bed reactor and in the presence of hydrogen and of a selective hydrogenation catalyst of NiMo type on alumina, under the conditions indicated in Table 7.

TABLE 7

| conditions of the selective hydrogenation step a) | | |
|---|---|---|
| Reactor inlet temperature | ° C. | 130 |
| Reactor outlet temperature | ° C. | 138 |
| Average temperature (WABT) | ° C. | 134 |
| Partial pressure of hydrogen | MPa abs | 6.4 |
| $H_2$/HC (volume coverage of hydrogen relative to the feedstock volume) | $Nm^3/m^3$ | 10 |
| HSV (volume flow rate of feedstock/volume of catalysts) | $h^{-1}$ | 6 |

The conditions indicated in Table 7 correspond to conditions at the start of the cycle and the average temperature (WABT) is increased by 4° C. per month so as to compensate for the catalytic deactivation.

At the outcome of the selective hydrogenation step a), the degrees of conversion (=(initial concentration−final concentration)/initial concentration) observed are indicated in Table 8.

TABLE 8

| conversions of the entities during the selective hydrogenation step a) | | |
|---|---|---|
| Degree of diolefin conversion | % | 35 |
| Degree of olefin conversion | % | 6 |
| Retention of silicon | % | <1 |

The effluent obtained from the selective hydrogenation step a) is subjected directly, without separation, to a hydrotreatment step b) performed in a fixed bed and in the presence of hydrogen, of a hydrocarbon-based recycle stream and of a hydrotreatment catalyst of NiMo type on alumina under the conditions presented in Table 9.

TABLE 9

| conditions of the hydrotreatment step b) | | |
|---|---|---|
| Hydrotreatment average temperature (WABT) | ° C. | 355 |
| Partial pressure of hydrogen | MPa abs | 6.2 |
| $H_2$/HC (volume coverage of hydrogen relative to the feedstock volume) | $Nm^3/m^3$ | 300 |
| HSV (volume flow rate of feedstock/volume of catalysts) | $h^{-1}$ | 0.5 |

The conditions indicated in Table 9 correspond to conditions at the start of the cycle and the average temperature (WABT) is increased by 2° C. per month so as to compensate for the catalytic deactivation.

The effluent obtained from the hydrotreatment step b) is subjected to a separation step c): a stream of water is injected into the effluent obtained from the hydrotreatment step b); the mixture is then treated in an acid gas washing column and separating vessels so as to obtain a gas fraction and a liquid effluent. The yields for the various fractions obtained after separation are indicated in Table 10 (the yields correspond to the ratios of the mass amounts of the various products obtained relative to the mass of feedstock upstream of step a), expressed in percentage and noted as % m/m).

TABLE 10

| yields of the various products obtained after separation | | |
|---|---|---|
| Gas fraction $NH_3$ + $H_2S$ + C1-C4 | % m/m | 0.85 |
| Liquid fraction | % m/m | 99.50 |

The process carried out according to the prior art and not in accordance with the invention results in catalytic deactivations during the selective hydrogenation step a) and during the hydrotreatment step b) which are greater than the catalytic deactivations observed in the process carried out according to the invention during the hydrogenation step a) and during the hydrotreatment step b).

The invention claimed is:

1. A process for treating a feedstock comprising a plastics pyrolysis oil comprising chlorinated compounds, said process comprising:

a) a hydrogenation step performed in a hydrogenation reaction section, containing at least one fixed-bed reactor containing n catalytic beds, n being an integer greater than or equal to 1, each comprising at least one hydrogenation catalyst, said hydrogenation reaction section being fed at least with said feedstock containing the plastics pyrolysis oil containing chlorinated compounds and a gas stream comprising hydrogen, said hydrogenation reaction section having an average temperature of between 14° and 400° C., a partial pressure of hydrogen of between 1.0 and 10.0 MPa abs, and an hourly space velocity of between 0.1 and 10.0 $h^{-1}$, an outlet temperature of the reaction section of step a) being at least 15° C. higher than the an inlet temperature of the reaction section of step a), to obtain a hydrogenated effluent, b) a hydrotreatment step performed in a hydrotreatment reaction section, containing at least one fixed-bed reactor containing n catalytic beds, n being an integer greater than or equal to 1, each comprising at least one hydrotreatment catalyst, said hydrotreatment reaction section being fed at least with said hydrogenated effluent obtained from step a) and a gas stream comprising hydrogen, said hydrotreatment reaction section having an average temperature of between 25° and 430° C., a partial pressure of hydrogen of between 1.0 and 10.0 MPa abs, and an hourly space velocity of between 0.1 and 10.0 $h^{-1}$, an average temperature of the reaction section of step b) being higher than an average temperature of the hydrogenation reaction section of step a), to obtain a hydrotreated effluent, b') a hydrocracking step performed in a hydrocracking reaction section, containing at least one fixed bed containing n catalytic beds, n being an integer greater than or equal to 1, each comprising at least one hydrocracking catalyst, said hydrocracking reaction section being fed at least with said hydrotreated effluent obtained from step b) and a gas stream comprising hydrogen, optionally being additionally fed with the cut comprising compounds having a boiling point greater than 175° C. obtained from step d), said hydrocracking reaction section having an average temperature of between 25° and 450° C., a partial pressure of hydrogen of between 1.5 and 20.0 MPa abs, and an hourly space velocity of between 0.1 and 10.0 $h^{-1}$, to obtain a hydrocracked effluent, c) a separation step, fed with the hydrocracked effluent obtained from step b') and an aqueous solution, said step being performed at a temperature of between 5° and 370° C., to obtain at least one gaseous effluent, an aqueous effluent and a hydrocarbon-based effluent, wherein step c) comprises an injection of an aqueous solution into the hydrotreated effluent obtained from step b), or the hydrocracked effluent obtained from the optional step b'), upstream of the separation step, and d) a step of fractionating all or a portion of the hydrocarbon-based effluent obtained from step c), to obtain at least one gaseous effluent and at least one cut comprising compounds with a boiling point of less than or equal to 175° C. and one hydrocarbon-based cut comprising compounds with a boiling point of greater than 175° C.

2. The process according to claim 1, in which an amount of the gas stream comprising hydrogen feeding said reaction section of step a) is such that hydrogen coverage is between 50 and 1000 $Nm^3$ of hydrogen per $m^3$ of feedstock.

3. The process according to claim 1, in which an amount of the gas stream comprising hydrogen feeding said reaction section of step a) is such that hydrogen coverage is between 200 and 300 $Nm^3$ of hydrogen per $m^3$ of feedstock.

4. The process according to claim 1, in which the outlet temperature of step a) is at least 30° C. higher than the inlet temperature of step a).

5. The process according to claim 1, in which at least one fraction of the hydrocarbon-based effluent obtained from the separation step c) or at least one fraction of the cut comprising compounds with a boiling point of less than or equal to 175° C. obtained from the fractionation step d) is sent into the hydrogenation step a) and/or the hydrotreatment step b).

6. The process according to claim 1, in which at least one fraction of the cut comprising compounds with a boiling point of greater than 175° C. obtained from the fractionation step d) is sent to the hydrogenation step a) and/or the hydrotreatment step b) and/or the hydrocracking step b').

7. The process according to claim 1, further comprising a step a0) of pretreating the feedstock comprising a plastics pyrolysis oil, said pretreatment step being carried out upstream of the hydrogenation step a) and comprises a filtration step and/or an electrostatic separation step and/or a step of washing by means of with an aqueous solution and/or an adsorption step.

8. The process according to claim 1, in which at least one of the two liquid hydrocarbon-based streams obtained from step d) is totally or partly sent into a steam cracking step e) performed in at least one pyrolysis furnace at a temperature of between 70° and 900° C. and at a pressure of between 0.05 and 0.3 MPa relative.

9. The process according to claim 1, in which the reaction section of step a) contains at least two reactors operating in permutable mode.

10. The process according to claim 1, in which a stream containing an amine is injected upstream of step a).

11. The process according to claim 1, in which said hydrogenation catalyst comprises a support selected from the group consisting of alumina, silica, silica-aluminas, magnesia, clays and mixtures thereof, and a hydro-dehydrogenating function comprising either at least one group VIII element and at least one group VIB element, or at least one group VIII element.

12. The process according to claim 1, in which said hydrotreatment catalyst comprises a support selected from the group consisting of alumina, silica, silica-aluminas, magnesia, clays and mixtures thereof, and a hydro-dehydrogenating function comprising at least one group VIII element and/or at least one group VIB element.

13. The process according to claim 1, further comprising a second hydrocracking step b") performed in a hydrocracking reaction section, containing at least one fixed bed containing n catalytic beds, n being an integer greater than or equal to 1, each comprising at least one hydrocracking catalyst, said hydrocracking reaction section being fed with the cut comprising compounds having a boiling point greater than 175° C. obtained from step d) and a gas stream comprising hydrogen, said hydrocracking reaction section being at a temperature of between 25° and 450° C., a partial pressure of hydrogen of between 1.5 and 20.0 MPa abs, and an hourly space velocity of between 0.1 and 10.0$h^{-1}$, to obtain a hydrocracked effluent which is sent to the separation step c).

14. The process according to claim 1, in which said hydrocracking catalyst comprises a support selected from the group consisting of halogenated aluminas, combinations of boron and aluminium oxides, amorphous silica-aluminas and zeolites, and a hydro-dehydrogenating function comprising at least one group VIB metal selected from the group consisting of chromium, molybdenum, tungsten, and mixtures thereof, and/or at least one group VIII metal selected from the group consisting of iron, cobalt, nickel, ruthenium, rhodium, palladium and platinum.

15. A product obtained via the process according to claim 1, which product comprises, relative to the total weight of the product:

a total content of metallic elements of less than or equal to 5.0 ppm by weight, with a content of iron element of less than or equal to 100 ppb by weight, a content of silicon element of less than or equal to 1.0 ppm by weight, a sulfur content of less than or equal to 500 ppm by weight, a nitrogen content of less than or equal to 100 ppm by weight, a content of chlorine element of less than or equal to 10 ppm by weight.

* * * * *